US009821430B2

(12) United States Patent
Zhang et al.

(10) Patent No.: US 9,821,430 B2
(45) Date of Patent: Nov. 21, 2017

(54) POWER TOOLS

(71) Applicant: POSITEC POWER TOOLS (SUZHOU) CO., LTD., Suzhou, Jiangsu Province (JP)

(72) Inventors: Shisong Zhang, Suzhou (CN); Xiaoli Pang, Suzhou (CN); Jingtao Xu, Suzhou (CN); Yu Wu, Suzhou (CN)

(73) Assignee: Positec Power Tools (Suzhou) Co., Ltd., Suzhou, Jiangsu (CN)

( * ) Notice: Subject to any disclaimer, the term of this patent is extended or adjusted under 35 U.S.C. 154(b) by 675 days.

(21) Appl. No.: 14/369,676

(22) PCT Filed: Dec. 28, 2012

(86) PCT No.: PCT/CN2012/001747
§ 371 (c)(1),
(2) Date: Nov. 24, 2014

(87) PCT Pub. No.: WO2013/097297
PCT Pub. Date: Jul. 4, 2013

(65) Prior Publication Data

US 2015/0075830 A1 Mar. 19, 2015

(30) Foreign Application Priority Data

Dec. 28, 2011 (CN) ..... 2011 1 0447736
Dec. 28, 2011 (CN) ..... 2011 1 0447933
(Continued)

(51) Int. Cl.
*B25B 13/46* (2006.01)
*B24B 45/00* (2006.01)
(Continued)

(52) U.S. Cl.
CPC ..... *B24B 45/006* (2013.01); *B24B 23/022* (2013.01); *B24B 23/04* (2013.01); *B25F 5/00* (2013.01)

(58) Field of Classification Search
CPC ... B25F 5/02; B25F 5/00; B24B 37/20; B24B 45/00; B24B 45/006
(Continued)

(56) References Cited

U.S. PATENT DOCUMENTS 3,509,629 A * 5/1970 Fukuda ..... A61C 1/06 310/50
3,554,292 A * 1/1971 Lewis ..... E02F 3/844 172/4.5
(Continued)

FOREIGN PATENT DOCUMENTS

CN 1430547 A 7/2003
CN 1946517 A 4/2007
(Continued)

OTHER PUBLICATIONS

International Search Report of the ISA/CN, International Application No. PCT/CN2012/001747, dated Apr. 4, 2013, four (4) pages.
(Continued)

*Primary Examiner* — Robert Long
(74) *Attorney, Agent, or Firm* — TraskBritt

(57) ABSTRACT

The disclosure relates to a power tool with a quick-operated locking mechanism. The power tool comprises a housing, an output shaft configured to mount and drive a working head and provided with a carrier extending out of the housing, a fixer configured to fix the working head at the carrier of the output shaft, a locking mechanism configured to lock or release the fixer and a driving mechanism configured to move the locking mechanism between a locking position and a releasing position. While in the locking position, the
(Continued)

fixer is clamped fixedly on the output shaft, and while in the releasing position, the fixer is released from the output shaft. The distance between the locking mechanism and the carrier of the output shaft keeps the fixer constant in the locking position to prevent slippage of the fixer and to ensure the working head is firmly fixed.

14 Claims, 25 Drawing Sheets

(30) Foreign Application Priority Data

Dec. 28, 2011 (CN) ..... 2011 1 0447941
Dec. 28, 2011 (CN) ..... 2011 1 0447974
Dec. 28, 2011 (CN) ..... 2011 1 0447995

(51) Int. Cl.
*B24B 23/04* (2006.01)
*B25F 5/00* (2006.01)
*B24B 23/02* (2006.01)

(58) Field of Classification Search
USPC ..... 173/29, 46, 50, 100, 110, 213
See application file for complete search history.

(56) References Cited

U.S. PATENT DOCUMENTS 3,866,692 A * 2/1975 Stelljes ..... B23B 45/008 173/110
4,091,880 A * 5/1978 Troutner ..... A61B 17/1628 173/170
4,347,450 A * 8/1982 Colligan ..... B23B 45/003 310/50
5,199,833 A 4/1993 Fehrle et al.
5,817,119 A * 10/1998 Klieman ..... A61B 17/29 606/170
5,832,611 A * 11/1998 Schmitz ..... B23D 49/11 173/29
5,940,977 A * 8/1999 Moores, Jr. ..... B23D 49/11 30/392
6,135,461 A 10/2000 Below et al.
6,324,947 B2 * 12/2001 Jarvis ..... B25B 23/0021 81/177.2
6,386,075 B1 * 5/2002 Shiao ..... B25G 1/066 16/438
6,569,001 B2 * 5/2003 Rudolf ..... B24B 45/006 451/344
6,929,074 B1 * 8/2005 Lai ..... B25B 21/00 173/178
7,281,591 B2 * 10/2007 Bone ..... H01R 35/02 173/170
7,344,435 B2 3/2008 Pollak et al.
7,431,188 B1 * 10/2008 Marczyk ..... A61B 17/072 227/175.1
8,113,410 B2 * 2/2012 Hall ..... A61B 17/07207 227/176.1
8,695,725 B2 * 4/2014 Lau ..... B25F 3/00 173/170
8,925,931 B2 * 1/2015 Sergyeyenko ..... B24B 23/04 279/141
8,991,516 B2 * 3/2015 Wei ..... B25D 11/068 173/122
9,061,410 B2 * 6/2015 Zhou ..... B25F 5/00
9,339,927 B2 * 5/2016 Xu ..... B27B 19/006
9,486,909 B2 * 11/2016 Zieger ..... B24B 23/022
9,486,934 B2 * 11/2016 Zhou ..... B23Q 3/14
2002/0011344 A1 * 1/2002 Alsruhe ..... B25B 21/00 173/217
2002/0028644 A1 3/2002 Rudolf et al.
2003/0095842 A1 * 5/2003 Bone ..... B25F 5/02 408/234
2005/0034276 A1 * 2/2005 Badiali ..... B25F 5/026 16/426
2006/0096770 A1 * 5/2006 Roberts ..... B25F 5/02 173/217
2007/0000138 A1 * 1/2007 Baskar ..... A01G 3/0417 30/392
2007/0084616 A1 * 4/2007 Lam ..... B25F 5/02 173/217
2007/0144752 A1 * 6/2007 Pozgay ..... B25B 21/00 173/216
2007/0272060 A1 * 11/2007 Schoenbeck ..... B25G 1/066 81/177.8
2008/0027449 A1 * 1/2008 Gundlapalli ..... A61B 17/1613 606/82
2009/0145259 A1 6/2009 Wall et al.
2009/0156107 A1 6/2009 Guenther et al.
2010/0001036 A1 * 1/2010 Marczyk ..... A61B 17/07207 227/175.1
2011/0072946 A1 * 3/2011 Bernardi ..... B25F 5/00 83/522.11
2011/0266758 A1 * 11/2011 Sergyeyenko ..... B24B 23/04 279/106
2011/0266759 A1 11/2011 Goldman
2012/0074657 A1 3/2012 Zhou
2012/0086177 A1 * 4/2012 Zhou ..... B25F 5/00 279/140
2012/0211951 A1 * 8/2012 Montplaisir ..... B24B 23/04 279/141
2012/0324744 A1 * 12/2012 Henrickson ..... A61B 17/144 30/394
2013/0008677 A1 * 1/2013 Huifu ..... B25F 3/00 173/29
2013/0082449 A1 4/2013 Bernardi et al.
2013/0193655 A1 * 8/2013 Kaye, Jr. ..... B27B 19/006 279/141
2013/0213684 A1 * 8/2013 Ikuta ..... B27B 19/006 173/213
2014/0015207 A1 * 1/2014 Kaye, Jr. ..... B25F 3/00 279/143
2014/0084552 A1 * 3/2014 Zieger ..... B24B 23/022 279/141
2014/0144655 A1 * 5/2014 Fuchs ..... B24B 23/04 173/46
2014/0144662 A1 * 5/2014 Zhou ..... B23Q 3/14 173/213
2014/0182872 A1 * 7/2014 Rubens ..... B27B 19/006 173/213
2014/0190715 A1 * 7/2014 Wong ..... B25B 21/00 173/39
2014/0260745 A1 * 9/2014 Rommel ..... B25F 5/001 74/417
2015/0069724 A1 * 3/2015 Wierzchon ..... B25F 3/00 279/144
2015/0122526 A1 * 5/2015 Bernardi ..... B26B 7/00 173/213
2015/0135541 A1 * 5/2015 Wierzchon ..... B27B 19/006 30/276
2015/0151415 A1 * 6/2015 Saitou ..... B25B 21/00 173/93
2016/0184984 A1 * 6/2016 Dresen ..... B24B 23/04 173/1

FOREIGN PATENT DOCUMENTS

CN 201493829 U 6/2010
CN 201669688 U 12/2010
CN 201736204 U 2/2011
CN 201792324 U 4/2011
CN 102328304 A 1/2012
DE 2221135 A1 11/1972
DE 3832624 A1 4/1990
DE 298 09 788 U1 9/1999
DE 202011051408 U1 12/2011
EP 0253181 A2 1/1988
EP 1180416 A2 2/2002
EP 2070659 A1 6/2009

(56) References Cited

FOREIGN PATENT DOCUMENTS

| | | | |
|---|---|---|---|
| EP | 2213416 | A2 | 8/2010 |
| GB | 118872 | A | 9/1918 |
| WO | 2013049482 | A2 | 4/2013 |

OTHER PUBLICATIONS

European Search Report for European Application No. 12861565.5, dated Jul. 9, 2015, 10 pages.
Chinese First Office Action for Chinese Application No. 201110447736.X dated Sep. 28, 2014, 17 pages.
Chinese First Office Action for Chinese Application No. 201110447933.1 dated Sep. 29, 2014, 10 pages.
Chinese First Office Action for Chinese Application No. 201110447941.6 dated Oct. 10, 2014, 8 pages.
Chinese First Office Action for Chinese Application No. 201110447974.0 dated Oct. 10, 2014, 12 pages.
Chinese First Office Action for Chinese Application No. 201110447995.2 dated Sep. 3, 2014, 8 pages.
Chinese Second Office Action for Chinese Application No. 201110447736.X dated Jun. 3, 2015, 7 pages.
Chinese Second Office Action for Chinese Application No. 201110447941.6 dated May 14, 2015, 8 pages.
Chinese Second Office Action for Chinese Application No. 201110447974.0 dated May 22, 2015, 15 pages.
Chinese First Search for Chinese Application No. 201110447736.X dated Sep. 19, 2014, 1 page.
Chinese First Search for Chinese Application No. 201110447933.1 dated Sep. 18, 2014, 1 page.
Chinese First Search for Chinese Application No. 201110447941.6 dated Sep. 19, 2014, 2 pages.
Chinese First Search for Chinese Application No. 201110447974.0 dated Sep. 26, 2014, 1 page.
European Examination Report for European Application No. 12861565, dated Jun. 22, 2016, 6 pages.
International Written Opinion for International Application No. PCT/CN2012/001747, dated Jun. 28, 2014, 7 pages.

* cited by examiner

POWER TOOLS

CROSS-REFERENCE TO RELATED APPLICATIONS

This application is a national phase entry under 35 U.S.C. §371 of International Patent Application PCT/CN2012/001747, filed Dec. 28, 2012, designating the United States of America and published in Chinese as International Patent Publication WO 2013/097297 A1 on Jul. 4, 2013, which claims the benefit under Article 8 of the Patent Cooperation Treaty and under 35 U.S.C. §119(e) to Chinese Patent Application Serial Nos. 201110447933.1, 201110447941.6, 201110447974.0, 201110447736.X, and 201110447995.2, all filed Dec. 28, 2011, the disclosure of each of which is hereby incorporated herein in its entirety by this reference.

FIELD

The present disclosure relates to power tools, in particular, to hand-held power tools.

BACKGROUND

An oscillating tool is a common hand-held oscillation power tool in this field. Its working principle is that the output shaft oscillates around its own axis. Therefore, many different operation functions such as sawing, cutting, grinding and scraping can be realized to meet different demands by installing different heads on the free end of the output shaft such as the straight saw blade, circular saw blade, triangular frosting pan and shovel-shaped scraper.

Chinese patent CN100574993C discloses an oscillating power tool with a quick clamping mechanism. The oscillating power tool comprises a working mandrel and a moving device capable of driving a fastening component to slide between the releasing position and the locking position. The tool can be fastened between a fastening component and a holding portion on the tool end of the working mandrel.

At the releasing position, the working mandrel can be dismantled from the fastening component; at the locking position, the fastening component clamps the holding portion through a spring. Wherein, the fastening component comprises a clamping shaft. The clamping shaft can be inserted into the working mandrel, maintained at the locking position through the locking mechanism in the working mandrel, and when located at the releasing position, can be removed. The locking mechanism has a clamping member capable of moving radially.

The locking mechanism comprises a collar. The clamping member can radially move to press against the collar. The clamping member is maintained in the recess of the collar. The clamping member has an inclined surface on one side facing the tool. The inclined surface is mated with the inclined surface on the collar such that the collar is pressed against the inclined surface of the clamping member, thus driving the clamping member to move to clamp the clamping shaft of the fastening component, and quickly clamping or releasing the fastening component.

However, in the above oscillating power tool, the movable assembly can rotatably operate the lever around an axis vertical to the output shaft. When the lever is operated to rotate to the open position, the cam surface on the lever extrudes the pushing member such that the locking mechanism overcomes the spring force of the spring and then axially moves downward, thus releasing the fastening component. To clamp the fastening component, the lever is required to be rotated from the open position back to the closed position, and then the locking mechanism axially moves upward by the effect of the spring force of the spring and quickly clamps the fastening component. The axial pressing force is supplied through the spring force of the spring. When there is a relatively large load, the axially downward outer force exceeds the axially upward pressing force provided by the spring, and then the fastening component and the locking mechanism together presses the spring and then axially moves downward by a certain distance, causing spacing between the fastening component and the tool. Then, the tool gets loose and slips, affecting the working efficiency. In addition, the quick clamping mechanism of the power tool needs a relatively large lever, and the lever is required to be rotated when the fastening is released or clamped. The operation is complicated.

Therefore, it is necessary to provide an improved power tool to solve the above problems.

DISCLOSURE

The aim of the present disclosure is to provide a power tool with mounting the working head on the output shaft in a more reliable way without any auxiliary tool such as the wrench and that can prevent slippage of the working head while working. The present disclosure provides a power tool comprising a housing, an output shaft being configured to oscillate about an axis in a reciprocating way and used for mounting and driving a working head, the output shaft is provided with a carrier extending out of the housing, a fixing element used for fixing the working head at the carrier of the output shaft, a locking mechanism used for locking or releasing the fixing element and a driving mechanism used for moving the locking mechanism between a locking position and a releasing position, while in the locking position, the fixing element is clamped fixedly on the output shaft, and while in the releasing position, the fixing element is capable to release from the output shaft, The driving mechanism comprises a driving unit and a driven unit mating with the driving unit. The movement of the driving unit brings the axial movement of the driven unit and the locking mechanism. The locking mechanism is supported by the driven unit and the driven unit is supported by the driving unit when in the locking position.

Preferably, at least one of the driving unit or the driven unit is provided with a first meshing surface for mating, the rotation of the driving unit drives the driven unit to axially move by the first meshing surface.

Preferably, the first meshing surface is a plane.

Preferably, the first meshing surface is perpendicular to the axis of the output shaft.

Preferably, the angle between the plane and the axis of the output shaft is an acute angle.

Preferably, the first meshing surface is a cam surface.

Preferably, the driving unit is rotatable around the axis of the output shaft or a line parallel to the axis of the output shaft.

Preferably, the driving unit rotates around a line perpendicular to the axis of the output shaft.

Preferably, the first meshing surface is disposed on the driving unit and a second meshing surface meshing with the first meshing surface is disposed on the driven unit.

Preferably, the second meshing surface is inclined to the axis of the output shaft and at least comprises a fast section and a slow section connected with each other, the lift angle of the fast section is greater than the slow section.

Preferably, the first meshing is inclined that the lift angle is equal to the lift angle of the slow section.

Preferably, both of the driving unit and the driven unit are cylindrical and the first meshing surface is on the circle of the driving unit or the driven unit.

Preferably, the driving mechanism further comprises a driving element, the rotation of the driving element is capable to drive the driving unit to rotate.

Preferably, the driving unit comprises a first stop and the driven unit comprises a second stop, when the locking mechanism is in the locking position, the first stop is mated with the second stop for limiting the rotation of the driving unit.

Preferably, when the locking mechanism is in the locking position, the locking mechanism is rigid supported by the driving mechanism and the axial distance between the locking mechanism and the carrier of the output shaft is remain unchanged.

The driving mechanism is capable to quickly operate the locking mechanism locking or releasing the fixing element without any auxiliary tools to get the working head fast assembled or disassembled. Because the distance between the locking mechanism and the carrier of the output shaft remains unchanged, the slippage of the fixing element in heavy load is avoided to hence the stability of the working head while working.

Another aim of the present disclosure is to provide a power tool in which the working head is mounted on the output shaft in a reliable way without any auxiliary tool, such as the wrench, for simpler operation steps and better hand feeling.

The present disclosure provides a power tool comprising: a housing; an output shaft configured to mount and drive a working head, the output shaft being provided with a carrier extending out of the housing; a fixing element used for fixing the working head at the carrier of the output shaft; a locking mechanism used for switching between the locking position and releasing position, the fixing element being clamped on the output shaft in the locking position and released from the output shaft in the releasing position; and a driving mechanism movable between a first position and a second position. The locking mechanism is in the locking position when the driving mechanism is in the first position and in the releasing position when the driving mechanism is in the second position. The driving mechanism further comprises a first elastic unit that makes the driving mechanism automatically return from the second position to the first position when the locking mechanism moves from the releasing position to the locking position.

Preferably, the driving mechanism further comprises a driving unit supported on the output shaft and a driven unit mating with the driving unit, the movements of the driving unit brings axial movements of the driven unit and the locking mechanism.

Preferably, at least one of the driving unit or the driven unit is provided with a first meshing surface, the rotation of the driving unit drives the driven to axially move by the first meshing surface.

Preferably, the first meshing surface is a plane.

Preferably, the first meshing surface is perpendicular to the axis of the output shaft.

Preferably, the angle between the first meshing surface and the axis of the output shaft is an acute angle.

Preferably, the first meshing surface is a cam surface.

Preferably, the driving unit is rotatable around the axis of the output shaft or a line parallel to the axis of the output shaft.

Preferably, the driving unit rotates around a line perpendicular to the axis of the output shaft.

Preferably, the first meshing surface is disposed on the driving unit and a second meshing surface meshing with the first meshing surface is disposed on the driven unit.

Preferably, the second meshing surface is inclined to the axis of the output shaft and at least comprises a fast section and a slow section connected with each other, the lift angle of the fast section is greater than the slow section.

Preferably, the first meshing is inclined that the lift angle is equal to the lift angle of the slow section.

Preferably, the driving mechanism further comprises a driving element, the rotation of the driving element is capable to drive the driving unit to rotate.

Preferably, both of the driving unit and the driven unit are cylindrical and the first meshing surface is on the circle of the driving unit or the driven unit.

Preferably, when the locking mechanism is in the locking position, the locking mechanism is rigid supported by the driving mechanism and the axial distance between the locking mechanism and the carrier of the output shaft is remain unchanged.

The driving mechanism is capable to quickly operate the locking mechanism locking or releasing the fixing element without any auxiliary tools to get the working head fast assembled or disassembled. The first elastic unit is capable to make the driving mechanism automatically return from the second position to the first position when the locking mechanism moves from the releasing position to the locking position for simpler operation steps, more convenient to change the working head and better operation feeling.

Another aim of the present disclosure is to provide a power tool in which the working head is mounted on the output shaft in a reliable way without any auxiliary tool, such as the wrench, for avoiding the slippage of the working head while working.

The present disclosure provides a power tool comprising a housing, an output shaft configured to mount and drive a working head, the output shaft is provided with a carrier extending out of the housing, a fixing element used for fixing the working head at the carrier of the output shaft, a locking mechanism used for locking or releasing the fixing element, a driving mechanism movable between a locking position and a releasing position, the fixing element is clamped on the output shaft when the driving mechanism is in the locking position and is released from the output shaft when the driving mechanism is in the releasing position. The driving mechanism comprises a driving unit and a driven unit, the driving unit and the mating unit are capable of moving relative to each other. The movement of the driving unit brings the axial movement of the driven unit and the locking mechanism. The locking mechanism is supported by the driven unit and the driven unit is supported by the driving unit when in the locking position.

Preferably, at least one of the driving unit or the driven unit is provided with a first meshing surface for mating, the rotation of the driving unit drives the driven unit to axially move by the first meshing surface.

Preferably, the first meshing surface is a plane.

Preferably, the first meshing surface is perpendicular to the axis of the output shaft.

Preferably, the angle between the plane and the axis of the output shaft is an acute angle.

Preferably, the first meshing surface is a cam surface.

Preferably, the driving unit rotates around the axis of the output shaft or a line parallel to the axis of the output shaft.

Preferably, the driving unit rotates around a line perpendicular to the axis of the output shaft.

Preferably, the first meshing surface is disposed on the driving unit and a second meshing surface meshing with the first meshing surface is disposed on the driven unit.

Preferably, the second meshing surface is inclined to the axis of the output shaft and at least comprises a fast section and a slow section connected with each other, the lift angle of the fast section is greater than the slow section.

Preferably, the first meshing is inclined that the lift angle is equal to the lift angle of the slow section.

Preferably, both of the driving unit and the driven unit are cylindrical and the first meshing surface is on the circle of the driving unit or the driven unit.

Preferably, the driving mechanism further comprises a driving element, the rotation of the driving element is capable to drive the driving unit to rotate.

Preferably, the driving unit comprises a first stop and the driven unit comprises a second stop, when the locking mechanism is in the locking position, the first stop is mated with the second stop for limiting the rotation of the driving unit.

Preferably, when the locking mechanism is in the locking position, the locking mechanism is rigid supported by the driving mechanism and the axial distance between the locking mechanism and the carrier of the output shaft is remain unchanged.

Preferably, the driving mechanism comprises a first elastic unit, which provides a biasing force to rotate the driving unit relative to the output shaft.

The driving mechanism is capable to quickly operate the locking mechanism locking or releasing the fixing element without any auxiliary tools to get the working head fast assembled or disassembled. The driving mechanism comprises a driving unit and a driven unit mating with the driving unit, the locking mechanism is supported by the driven unit and the driven unit is supported by the driving unit when in the locking position to avoid the slippage of the fixing element in a heavy load and ensure the working head firmly fixed.

Another aim of the present disclosure is to provide a power tool in which the working head is mounted on the output shaft in a reliable way without any auxiliary tool, such as the wrench, for avoiding the slippage of the working head while working.

The present disclosure provides a power tool comprising a housing, an output shaft configured to oscillate about an axis in a reciprocating way and used for mounting and driving a working head, the output shaft is provided with a carrier extending out of the housing, a fixing element comprises a pressing portion for fixing the working head at the carrier of the output shaft, a driving mechanism movable between a first mating position and a second mating position, the pressing portion of the fixing element is clamped on the output shaft when the driving mechanism is in the first mating position and is released from the output shaft when the driving mechanism is in the second mating position. The driving mechanism comprises a driving unit and a driven unit, the driving unit and the mating unit are capable of moving relative to each other, the fixing element is configured to move axially by moving the driving unit and to be axially fixed by supporting of the driving unit or mating unit in the first mating position.

Preferably, rotary movement of the driving unit relative to the mating unit makes the driving mechanism to move between the first mating position and the second mating position.

Preferably, the driving unit is provided with a meshing portion and the mating unit is provided with a second meshing portion for mating with the first meshing portion, one of the first meshing portion and the second meshing portion is provided with a first meshing surface for mating.

Preferably, the first meshing surface is a cam surface.

Preferably, the first meshing surface is a plane and the angle between the plane and the axis of the output shaft is an acute angle.

Preferably, the other one of the first meshing portion and the second meshing portion is provided with a second meshing surface for mating with the first meshing surface.

Preferably, the driving unit is rotatable around the axis of the output shaft or a line parallel to the axis of the output shaft.

Preferably, the driving unit rotates around a line perpendicular to the axis of the output shaft.

Preferably, a self-locking mechanism is formed between the driving unit and the mating unit when the driving mechanism is in the second mating position.

Preferably, the moving distance of the driving unit is greater than the axial moving distance of the fixing element during the process of the driving mechanism moving from the second mating position to the first mating position.

Preferably, the fixing element is rigidly supported by the driving mechanism, and the axial distance between the pressing portion of the fixing element and the carrier of the output shaft keeps constant when the locking mechanism is in the second mating position.

Preferably, the fixing element further comprises a rod portion axially extending from the pressing portion into the output shaft, and the rod portion is suitable with the driving unit or the mating unit.

Preferably, the driving mechanism comprises a first elastic unit, when the fixing element is pressed to axially move, the driving mechanism automatically returns from the second mating position to the first mating position by the first elastic unit.

Preferably, the power tool further comprises an operation mechanism being configured to move the driving mechanism between the first mating position and the second mating position.

Preferably, the driving unit comprises a first stop, the mating unit comprises a second stop, when the driving mechanism is in the second mating position, the first stop is mating with the second stop for limiting the rotation of the driving unit.

The driving mechanism is capable to quickly operate the locking mechanism locking or releasing the fixing element without any auxiliary tools to get the working head fast assembled or disassembled. The driving mechanism further comprises a driving unit and a mating unit mating with the driving unit, the fixing element is supported by the driving unit or the mating unit in the first mating position to avoid the slippage of the fixing element in a heavy load and ensure the working head firmly fixed.

Another aim of the present disclosure is to provide a power tool in which the working head is mounted on the output shaft in a reliable way without any auxiliary tool, such as the wrench, for simpler operation steps and better hand feeling.

The present disclosure provides a power tool comprising a housing, an output shaft configured to oscillate about an axis in a reciprocating way and used for mounting and driving a working head, the output shaft is provided with a carrier extending out of the housing, a fixing element comprises a pressing portion for fixing the working head at the carrier of the output shaft, a driving mechanism movable between a first mating position and a second mating position, the pressing portion of the fixing element is clamped on the output shaft when the driving mechanism is in the first mating position and is released from the output shaft when the driving mechanism is in the second mating position. The driving mechanism comprises a first elastic unit. When the fixing element is pressed to axially move, the driving mechanism automatically returns from the second mating position to the first mating position by the first elastic unit.

Preferably, the driving mechanism comprises a driving unit and a mating unit mating capable to move relative to each other. The movement of the driving unit brings the axial movement of the driven unit.

Preferably, one end of the first elastic unit connects the driving unit and the other end connects the housing or the output shaft.

Preferably, the movement of the driving unit brings the axial movement of the mating unit and the fixing element is supported on the mating unit.

Preferably, the driving unit axially moves relative to the mating unit and the fixing element is supported on the driving unit.

Preferably, the driving unit rotates relative to the mating unit to make the driving mechanism rotate between the first mating position and the second mating position.

Preferably, the driving unit rotates around the axis of the output shaft or the straight line parallel to the axis of the output shaft.

Preferably, the driving unit rotates around straight line perpendicular to the axis of the output shaft.

Preferably, the first meshing portion is disposed on the driving unit and a second meshing portion meshing with the first meshing portion is disposed on the mating unit, one of the first meshing portion and the second meshing portion is provided with the first meshing surfaces for meshing.

Preferably, the first meshing surface is a cam surface.

Preferably, the first meshing surface is a plane and the angle between the plane and the axis of the output shaft is an acute angle.

Preferably, the other of the first meshing portion and the second meshing portion is provided with a second meshing surface meshing with the first meshing surface.

Preferably, the driving unit and the mating unit get self-locked when the driving mechanism is in the second mating position.

Preferably, the distance the driving unit move is greater than the axial distance the fixing element moved during the driving mechanism moved from the second mating position to the first mating position.

Preferably, the driving unit comprises a first stop and the driven unit comprises a second stop, when the driving mechanism is in the second mating position, the first stop is mated with the second stop for limiting the rotation of the driving unit.

Preferably, when the driving mechanism is in the second mating position, the fixing element is rigid supported by the driving mechanism and the axial distance between the pressing portion of the fixing element and the carrier of the output shaft is remain unchanged.

Preferably, the power tool further comprises an operation mechanism by which the driving mechanism is capable to move between the first mating position and the second mating position.

Preferably, a second elastic unit is provided between the driving mechanism and the output shaft or the housing. The fixing element is push out of the output shaft by the second elastic unit when the driving mechanism moves to the second mating position from the first mating position.

The driving mechanism is capable to quickly operate the locking mechanism locking or releasing the fixing element without any auxiliary tools to get the working head fast assembled or disassembled. When the fixing element is pressed to axially move, the driving mechanism automatically returns from the second mating position to the first mating position by the first elastic unit for simpler operation steps and better hand feeling and more convenient to change the working head.

BRIEF DESCRIPTION OF THE DRAWINGS

Further advantages are given by the following description of the drawing. The drawing shows exemplary embodiments of the disclosure. The drawing, the description and the claims contain numerous features in combination. Persons skilled in the art will also expediently consider the features individually and combine them to create appropriate further combinations. In the drawings:

DETAILED DESCRIPTION

Figure 1:
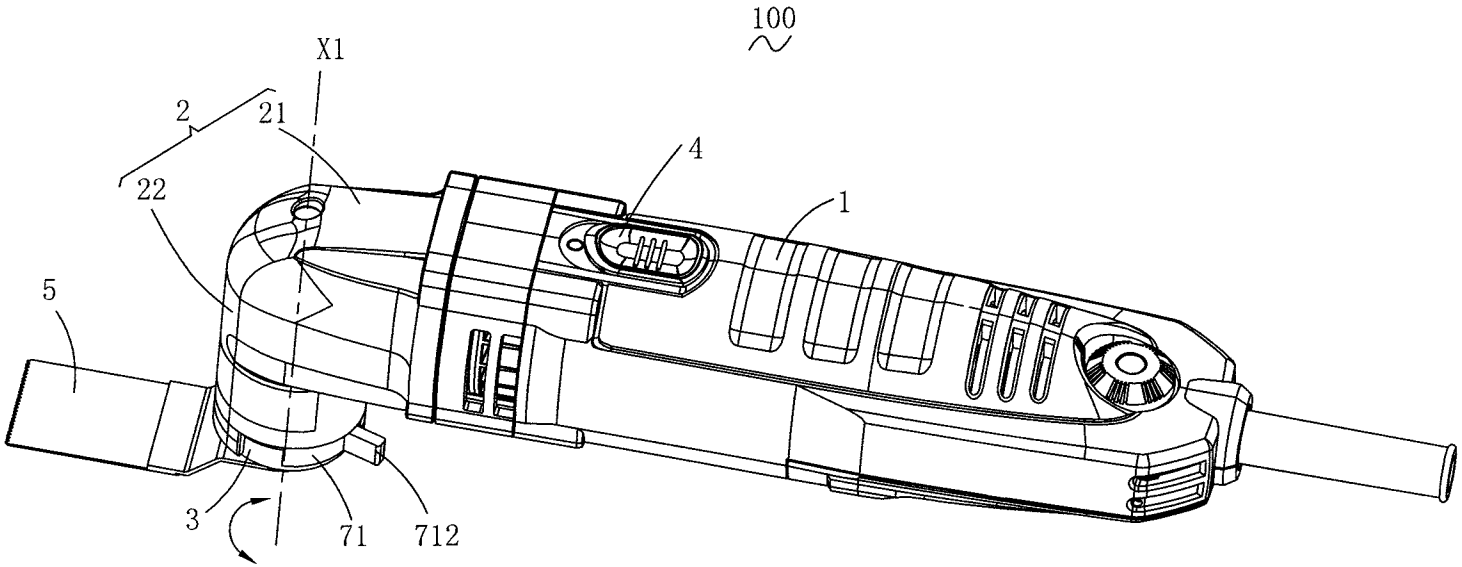
FIG. 1 shows a three-dimensional view of the power tool according to a first embodiment of the disclosure.

The present disclosure is described in further detail with reference to the attached drawings and the specific embodiments.

The power tool of the present disclosure comprises a housing, an output shaft installed in the housing, a fixing element for fixing a working head at the output shaft, a locking mechanism and a driving mechanism for locking or releasing the fixing element. The driving mechanism can switch between the first mating position and the second mating position so as to drive the locking mechanism to move between the locking position and the releasing position. At the locking position, the fixing element is clamped at the carrier of the output shaft; at the releasing position, the fixing element can be separated from the output shaft. Thus, the working head can be quickly replaced without auxiliary tools. The most important is that, at the locking position, the locking mechanism is rigidly supported by the driving mechanism, and the distance between the locking mechanism and the carrier of the output shaft is kept unchanged. This structure can ensure that the working head is steadily fixed at the output shaft by the fixing element and prevent the working head and the fixing element from loosening due to clearance appearing there-between on condition of overlarge external load, thus avoiding slippage when the working head is working and greatly improving the working efficiency.

The most important is that the driving mechanism is also provided with a first elastic unit. When the locking mechanism moves from the releasing position to the locking position, the first elastic unit can drive the driving mechanism to automatically return from the second position to the first position. Therefore, the operation steps the driving mechanism are reduced; the operation is simpler and the hand feel is better during replacement of the working head.

The most important is that the driving mechanism comprises a driving unit and a driven unit mated with the driving unit. Moving the driving unit can drive the driven unit to move axially so as to drive the locking mechanism to move axially. At the locking position, the locking mechanism is supported by the driven unit, and the driven unit is supported by the driving unit. This structure can ensure the working head is steadily fixed at the output shaft by the fixing element and prevent the working head and the fixing element from loosening due to clearance appearing there-between on condition of overlarge external load, thus avoiding slippage when the working head is working and greatly improving the working efficiency.

It should be pointed out that "rigid support" in the description refers to that after the locking mechanism is supported by the driving mechanism, the driving mechanism does not deform and cannot be elastically compressed in the axial direction by the action of an outer axial force.

The power tool of the present disclosure comprises a housing, an output shaft installed in the housing, a fixing element for fixing the working head at the output shaft, and a driving mechanism for driving the fixing element to move axially. The driving mechanism can switch between the first mating position and the second mating position. At the first mating position, the fixing element fixes the working head at the output shaft; at the second mating position, the fixing element releases the working head so as to dismantle the working head from the output shaft. Thus, the working head can be quickly installed or replaced without auxiliary tools.

The most important is that the driving mechanism comprises a driving unit and a mating unit mated with the driving unit. The driving unit can rotate relative to the mating unit, and the mating unit cannot rotate relative to the output shaft. Moving the driving unit can drive the mating unit to move axially so as to drive the fixing element to move axially. When the driving mechanism locates at the first mating position, the fixing element is supported by either the driving unit or the mating unit. This structure can ensure that the working head is steadily fixed at the output shaft by the fixing element and prevent the working head and the fixing element from loosening due to clearance appearing therebetween on condition of overlarge external load, thus avoiding slip when the working head is working and greatly improving the working efficiency.

What's more, the driving mechanism is also provided with a first elastic unit. When the fixing element is pressed axially, the first elastic unit can drive the driving mechanism to automatically return from the second mating position to the first mating position. Therefore, during replacement of the working head, the operation steps of the driving mechanism are reduced, and the operation is simpler and feels better.

Embodiment 1

The power tool described in this embodiment is an oscillating type power tool, also called oscillating tool. However, the present disclosure is not limited to the oscillating type power tools, and may also be a rotary type grinding power tool, such as the sander or angle finishing grinder.

Referring to FIG. 1, a power tool, specifically an oscillating tool 100, comprises a housing 1 extending lengthwise, a head cover 2 connected to the front end 1 (as shown in FIG. 1, the left side is defined as the front end) of the housing and an output shaft 3 extending out of the head cover 2. Wherein, the housing 1 is internally provided with a motor (not shown in the figure). The housing 1 is also provided with a switch 4 to control the startup or shutdown of the motor. The head cover 2 comprises a horizontal portion 21, which is connected with the housing 1 and is arranged along the horizontal direction as shown in FIG. 1, and a vertical portion 22, which approximately vertically extends downward along the tail end of the horizontal portion 21. The output shaft 3 is located in the vertical direction, having one end installed in the head cover 2 and the other end downward extending out of the vertical portion 22 of the head cover 2. The output shaft can swing around its own longitudinal axis X in a direction indicated by the double arrow in FIG. 1.

In addition, the head cover 2 is also internally provided with an eccentric element (not shown in the figure) and a fork assembly (not shown in the figure), which are common elements used on the oscillator so as to convert the rotary output torque of the motor into the oscillation output torque of the output shaft 3. When rotating, the eccentric member converts its rotation by fit with the fork assembly into the oscillation of the output shaft 3 around its own axis X, wherein the oscillation angle is approximate 0.5-7 degrees, and the oscillation frequency can be set to 5,000-30,000 turns/minute. The free end of the output shaft 3 can be equipped with a working head 5 through a fixing element (described in detail in the following text). In this embedment, the working head 5 is a kind of straight saw blade. The working head 5 can be driven by the output shaft 3 to oscillate along the direction indicated by the dual arrow in FIG. 1.

In comparison with the rotary type power tool, when the oscillation tool 100 is working, the output shaft 3 rotates and oscillates around its own axis X in a reciprocating way such that large breaking torques are generated along the two oscillation directions. Therefore, a huge axial holding force is needed to ensure that the head 5 is fixed on the output shaft 3 under all working conditions, and avoid slippage so as to guarantee the working efficiency or normal regular work.

Figure 2:
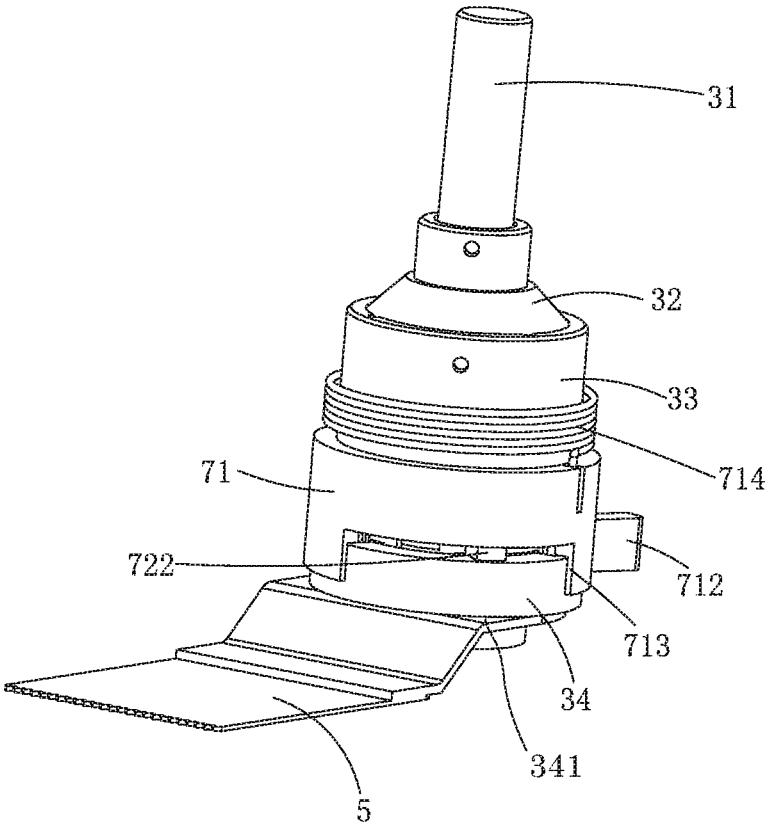
FIG. 2 shows a three-dimensional view of part of the power tool shown in FIG. 1.
Figure 3:
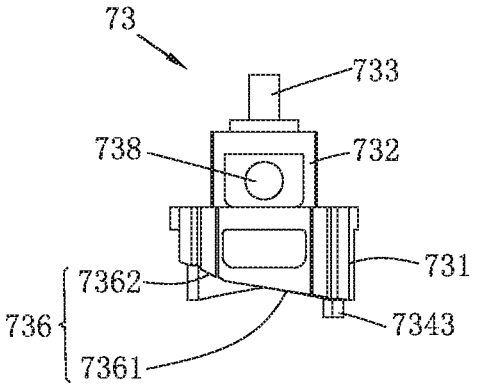
FIG. 3 shows a structural view of the driven unit according to the first embodiment of the disclosure.
Figure 4:
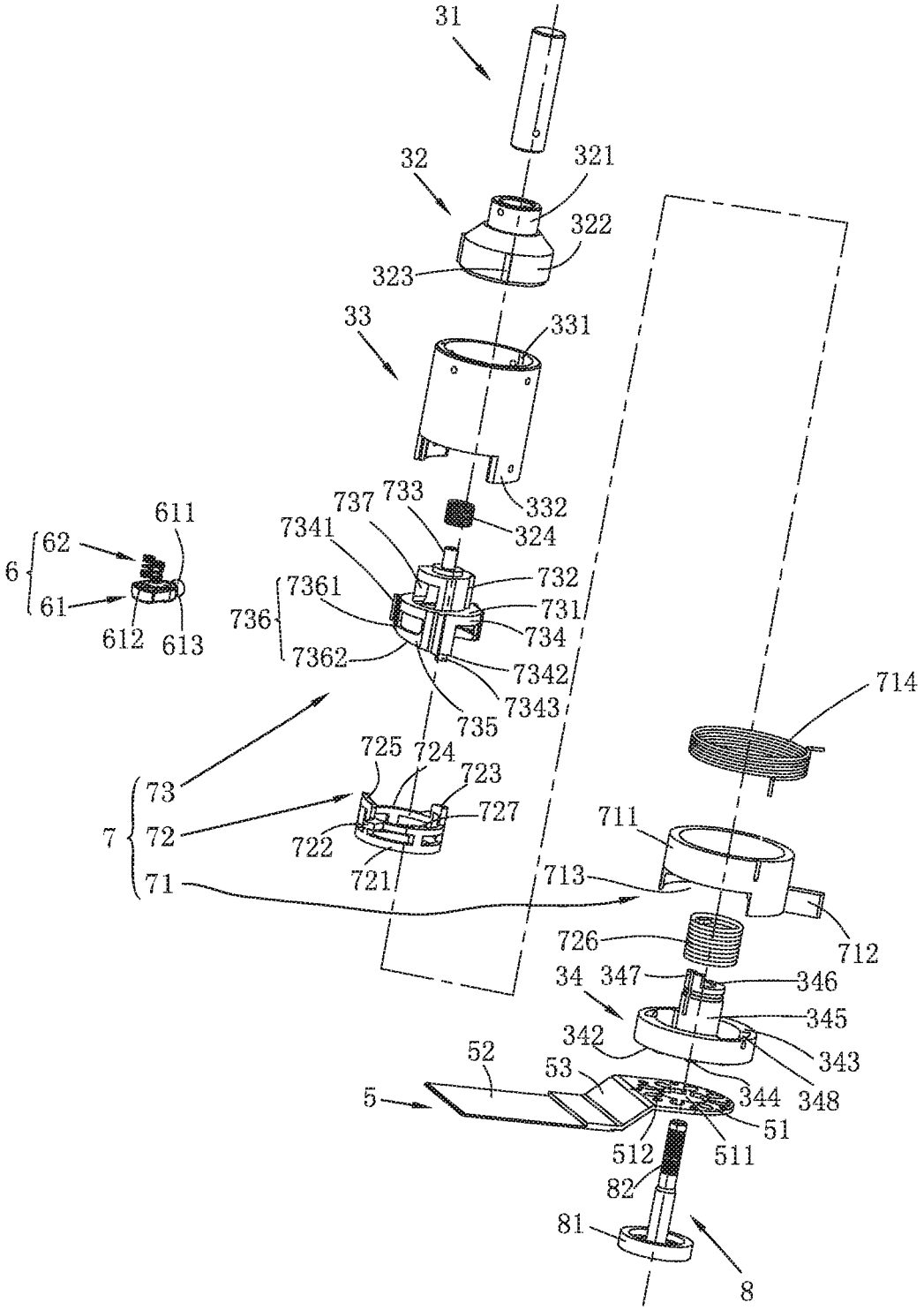
FIG. 4 shows a three-dimensional exploded view of part of the power tool shown in FIG. 2.

As shown in FIGS. 2-4, the direction of the straight line where the axis X of the output shaft 3 exists is defined as the lengthwise direction, while the direction vertical to the axis X is defined as the crosswise direction; the bottom of the paper is downward, and the top of the paper is upward. The following descriptions all employ such definition. The oscillating tool 100 also comprises a locking mechanism 6 and a driving mechanism 7, which are arranged in the output shaft 3. The locking mechanism 6 and the driving mechanism 7 are mated such that a fixing element 8 can be quickly clamped or released so as to quickly install or dismantle the working head 5.

The output shaft 3 is hollow, received in the head cover 2 and axially supported between a ball bearing 23 and a sleeve bearing 24, which are installed in the head cover 2 in parallel. In this embodiment, the output shaft 3 consists of four components from the top down: a shaft body 31, a shaft cap 32, a shaft sleeve 33 and a shaft base 34. Obviously, those four elements may not rotate relatively to transmit the rotation torque. Wherein, the shaft body 31 is cylindrical and connected with the shaft cap 32 through a pin (not shown in the figure), and one end thereof facing the working head 5 is provided with a blind hole 311. The shaft cap 32 is hollow, having a top section 321, which is hollow and cylindrical and receives the shaft body 31, and a bottom section 322, which is also hollow and cylindrical but greater in the radial dimension. The outer surface of the bottom section 322 protrudes in the radial direction and extends to form several ribs 323 at intervals, mated with the shaft sleeve 33 to transmit the rotation torque. The shaft sleeve 33 is also hollow cylindrical; the inner side wall thereof is provided with several recesses 331 for receiving the ribs 323 of the shaft sleeve 32; the bottom axially protrudes downwards and extends to form two symmetrical protrusions 332 and mated with the shaft base 34 through the protrusions 332 so as to transmit the rotation torque to the shaft base 34.

The shaft base 34 is located at the bottom of the output shaft 3 and has a carrier 341. The carrier 341 comprises a round footwall 342, a hollow and cylindrical outer coat 343, which axially extends upward from the outer edge of the footwall 342, and several protruding posts 344, which extend axially downward from the lower surface of the footwall 342 and are arranged in a circumferential way. The shaft base 34 also comprises a hollow and cylindrical inner coat 345, which extends upward from the middle part of the carrier 341, and a receiving bore 346 penetrating through the carrier 341 and the inner coat 345, wherein the top of the inner coat 345 extends upward to form a block portion 347 for blocking the axial downward movement of the locking mechanism 6. The inner wall of the outer coat 343 of the carrier 341 is symmetrically formed with two recess grooves 348 for just receiving the two protrusions 332 of the shaft sleeve 33 so as to transmit the rotation torque.

It should pointed out that, the output shaft of the present disclosure is not limited to the specific structure in this embodiment, wherein the shaft body 31, the shaft cap 32, the shaft sleeve 33 and the shaft base 34 can be provided a flat square structure two by two to transmit the rotation torque; the shaft body 31, the shaft cap 32 and the shaft sleeve 33 can be integrally molded as one component without affecting the properties of the entire machine.

The head 5 is a straight saw blade. Those skilled in this field can easily figure out that the working head 5 may be other attachments such as the circular saw blade, sand tray and scrapper. The working head 5 may be transversely arranged and has a plate-like mounting portion 51 installed at the output shaft 3, a cutting portion 52 for cutting and a connecting portion 53 located between the mounting portion 51 and the cutting portion 52. Wherein, the mounting portion 51 is provided with a center hole 511, and several mounting bores 512 mated with the protruding posts 344 of the output shaft 3 are arranged on the outer periphery of the center hole.

The fixing element 8 is used to fix the working head 5 at the tail end of the output shaft 3. The fixing element 8 passes through the mounting portion 51 of the working head 5 and then is connected to the tail end of the output shaft 3. The fixing element comprises an annular plate 81 at the bottom and a rod portion 82, which axially extends upward from the middle part of the plate 81; the tail end of the rod portion 82 is provided with a tooth portion 82; and the tooth portion 82 may be external screw threads or other toothed structures.

During installation, the rod portion 82 of the fixing element 8 penetrates through the receiving bore 346 of the output shaft 3 and then clamped by the locking mechanism 6 so as to clamp the mounting portion 51 of the working head 5 between the footwall 344 of the output shaft 3 and the plate 81.

Referring to FIGS. 2-4, the following are detailed descriptions of the specific structures of the locking mechanism 6 and the driving mechanism 7. The locking mechanism 6 can switch between the locking position and the releasing position; at the locking position, the fixing element 8 is clamped in the locking mechanism 6; and at the releasing position, the fixing element 8 is released by the locking mechanism 6 so as to be moved out of the output shaft 3. In this embodiment, the locking mechanism 6 can move from the locking position to the releasing position through operating the driving mechanism 7. In such circumstances, the fixing element 8 can be moved out of the output shaft 3. To install the fixing element 8, manually press the fixing element 8, and then the driving mechanism 7 can automatically return to the original position such that the locking mechanism 6 is kept at the locking position.

The driving mechanism 7 comprises a driving element 71, a driving unit 72 and driven unit 73, wherein the driving element 71 is sleeved on the outer periphery of the shaft sleeve 33 on the output shaft 3; the driving unit 72 and the driven unit 73 are installed in the output shaft 3, received in the receiving space formed by the shaft sleeve 33 and the shaft cap 32 and finally located between the locking mechanism 6 and the carrier 341 of the output shaft 3. The driving element 71 operably rotates around the axis X of the output shaft 3 and can drive the driving unit 72 to rotate around the axis X of the output shaft. During rotation, the driving unit 72 drives the driven unit 73 to axially move upward.

The driving element 71 is located in the vertical portion 22 of the head cover 2 and can rotate around the axis X of the output shaft 3. The driving element comprises an approximately hollow and cylindrical body 711 and a lever 712, which radially extends outward from the bottom of the body 711. The bottom of the body 711 is also formed with two centrosymmetric rectangular gaps 713, and the lever 712 is also rectangular and axially located as high as the gaps 713.

The driving unit 72 is made of rigidity materials, installed in the output shaft 3 and just located in the space formed between the outer cat 343 and the inner coat 345 of the shaft base 34. The driving unit 72 comprises a hollow and cylindrical body 721, two projecting portions 722 extending from the body 721 and two supporting portions 723. The two projecting portions 722 radially extend outward from the outside of the body 721 and respectively located in the gaps 713 of the driving element 71 in a centrosymmetric way; the body 721 has a horizontal upper surface 724; two supporting portions 723 are formed by the axially upward extending upper surface 724 of the body 721 and are also centrosymmetrically arranged. The body 721 is hollowed, and the supporting portions 723 are close to the projecting portions 722. Tops of the supporting portions 723 incline axially to form a first meshing surface 725. The first meshing surface 725 gradually rises along the clockwise direction and has a lift angle. A first elastic unit 726 is arranged between the driving unit 72 and the inner coat 345 of the shaft base 34. One end of the first elastic unit 726 is pressed against the inner coat 345, and the other end is pressed against the driving unit 72, so the driving unit 72 can automatically return to the original position after rotation. In addition, the body 721 radially extends from the inner side to form a first stop 727 so as to mate with the driven unit 73. When the locking mechanism 6 is located at the releasing position, the rotation of the driving unit 72 is limited by the effect of the first stop 727.

The driven unit 73 is also made of the rigid materials, axially installed above the driving unit 72. The driven unit comprises a mating section 731, a receiving section 732 and a guide rod 733 arranged in the axial direction in sequence, and the radial dimensions of those three reduce in sequence. Wherein, the receiving section 732 is located above the mating section 731, and the guide rod 733 is located above the receiving section 732. The mating section 731 is hollow, comprising a hollow and cylindrical base body 734 and several ribs 7341 formed by the outward projecting and extending outside of the base body 734. The ribs 7341 are just received in the recess portion 331 of the shaft sleeve 33 such that the driven unit 73 cannot rotate relative to the output shaft 3. The base body 734 has a horizontal lower surface 7342, and has a lower end inclined from the lower surface 7342 to form two meshing portions 735, which are respectively mated with the supporting portion 723 of the driving unit 72. The base body 734 axially protrudes and extends downward from the lower surface 7342 to form a second stop 7343 so as to mate with the first stop 727 of the driving unit 72 to limit the rotation of the driving unit 72. Tops of the meshing portions 735 axially incline to form a second meshing surface 736. The second meshing surface 736 gradually rises along the anticlockwise direction and is divided into a fast section 7361 and a slow section 7362. Wherein, the fast section 7361 has a second lift angle and the slow section 7362 has a third lift angle. The second lift angle is greater than the third lift angle, and the third lift angle is equal to the first lift angle of the first meshing surface 725 such that the fast section 7361 can fast drive the driven unit 72 to axially move upward when mated with the first meshing surface 725. The receiving section 732 of the driven unit 73 is provided with a receiving cavity 737 to receive the locking mechanism 6. The driven unit 73 has one side provided with an opening 738 and the other side provided with a bore 739 relative to the opening 738.

The locking mechanism 6 is received in the receiving cavity 737 of the driven unit 73, comprising a locking unit 61 and second elastic units 62. Wherein, the locking unit 61 is approximately plate-like, comprising a spherical head portion 611 on one side, two accommodating bores 612 located on the other side and a locking bore 613 located between the head portion 611 and the accommodating bores 612. There are two second elastic units 62, each of which one end is received in the accommodating bore 612 of the locking unit 61 and the other end is pressed against the roof of the receiving cavity 735 of the receiving section 732 of the driven unit 73. The locking unit 61 installed in the receiving cavity 735 of the driven unit 73 from the opening 738 of the driven unit 73, and the head portion 611 thereof is just received in the opening 739 of the driven unit 73. Moreover, one end of the locking unit 61 relative to the head portion 611 thereof can axially incline upward relative to the axis X of the output shaft 3, meaning that the head portion 611 pivots around the pivoting point in the axial direction.

To enable the driven unit 73 to move up and down in the vertical direction, a third elastic unit 324 is axially located between the driven unit 73 and the output shaft 3. The third elastic unit 324 is sleeved on the guide rod 733, with one end pressed against the upper surface of the receiving section 732 of the driven unit 73 and the other end received in and pressed against the blind hole 311 of the shaft body 31. To enable the driving element 71 to automatically return after being rotated from the original position, a fourth elastic unit 714 is located between the driving element 71 and the vertical portion 22 of the head cover 2. The fourth elastic unit 714 has one end pressed against the inner wall of the head cover 2 and the other end pressed against the body 711 of the driving element 71.

Referring to FIGS. 2-4, the assembly process of some components in the head cover 2 of the oscillating tool 2 is described in detail. First, install the driving unit 72 of the driving mechanism 7 in the shaft base 34 of the output shaft 3, arrange the first elastic unit 726 between the shaft base 34 and the inner coat 345; second, install the shaft sleeve 33 at the shaft base 34 and fix it relative to the shaft base 34; third, install the locking mechanism 6 in the driven unit 73 of the driving mechanism 7, mate the driven unit 73 with the recess portion 331 if the shaft base 33 through ribs 7341, install the driven unit 73 in the shaft sleeve 33, locate one end of the second elastic unit 62 that is equipped with the locking unit 61 directly above the stop 347 of the shaft base 34, meanwhile locate the meshing portion 735 of the driven unit 73 in a way of corresponding to the supporting unit 725 of the driving unit 72; fourth, install and fix the shaft cap 32 on the shaft sleeve 33, then install and fix the shaft body 31 on the shaft cap 32; and fifth, sleeve the driving element 71 on the shaft sleeve 33 of the output shaft 3 from the top down, and arrange the fourth elastic unit 714 between the driving element 71 and the head cover 2. So far, assembly of the main components in the head cover 2 is finished.

Referring to FIGS. 5-12, the locking process of the oscillating tool 100 in this embodiment is described through four position states. The driving mechanism 7 can drive the locking mechanism 6 to switch between the locking position and the releasing position. At the locking position, the fixing element 8 is clamped by the locking mechanism 6 so as to steadily fix the working head 5 at the carrier 341 of the output shaft 3; at the releasing position, the locking mechanism 6 releases the fixing element 8, and then the fixing element 8 can be moved out of the output shaft 3 so as to take down the working head 5.

Figure 5:
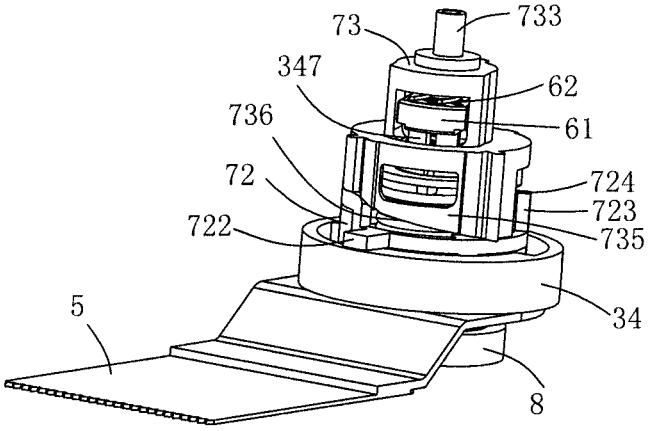
FIG. 5 shows a view of a part of the power tool shown in FIG. 2 in a first position, while the locking mechanism is in a released position.
Figure 6:
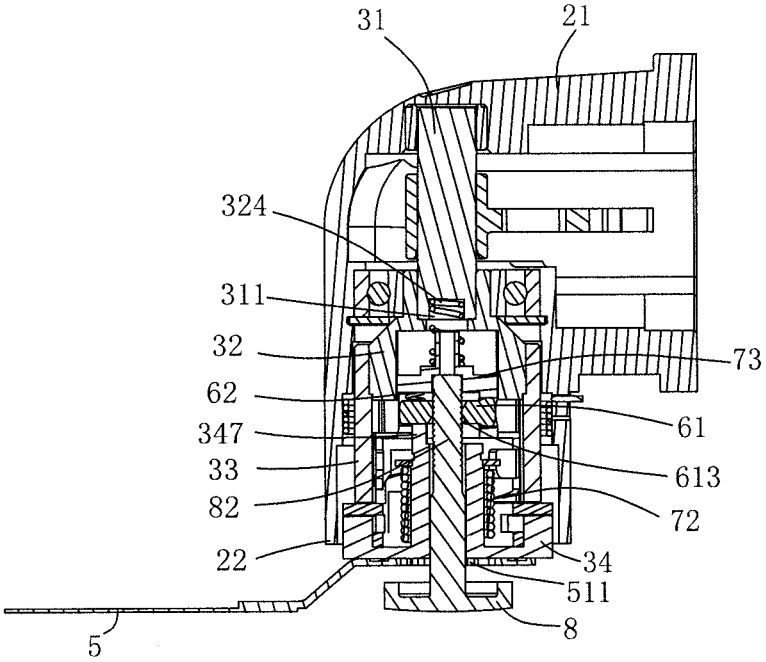
FIG. 6 shows a sectional view of the part of the power tool shown in FIG. 5.

FIGS. 5 and 6 are schematic views in which oscillating tool 100 is at the first position, and wherein the locking mechanism 6 is located at the releasing position. At this position, by the effect of the fourth elastic unit 324, the driven unit 73 moves downward by a certain distance until the lower surface 7342 of the mating section 731 of the driven unit 73 is pressed against the upper surface 724 of the body 721 of the driving unit 72. During downward movement, the locking unit 61 of the locking mechanism 6 is stopped by the stop 347 of the shaft base 34, and finally the locking unit 61 is located at a horizontal position vertical to the axis X of output shaft 3, and the inner surface of the locking bore 613 of the locking unit 61 is disengaged with the outer surface of the rod portion 82 of the fixing element 8. In such circumstances, the locking unit 61 and the fixing element 8 are located at the releasing position, and the fixing element 8 can be moved out of the locking unit 61. Before installing the fixing element 8 in the output shaft 3, install the working head 5 at the carrier 341 of the output shaft 3 first, then penetrate the fixing element 8 through the center hole 511 of the working head 5 and the receiving bore 346 of the shaft base 34 to enter the locking bore 613 of the locking unit 61, and press the fixing element 8 against the bottom of the receiving section 732 of the driven unit 73.

It should be pointed out that at the above releasing position the driving element 71 is driven by an outer force to rotate so as to drive the driving unit 72 to rotate a certain angle and overcome the torsional force of the fourth elastic unit 714. At the releasing position, although the external force is removed and the first stop 727 of the driving unit 72 is mated with the second stop 7343 of the driven unit 73, the driving unit 72 still cannot rotate even when affected by the torsional force of the fourth elastic unit 714, thus keeping the locking mechanism 6 at the releasing position.

Figure 7:
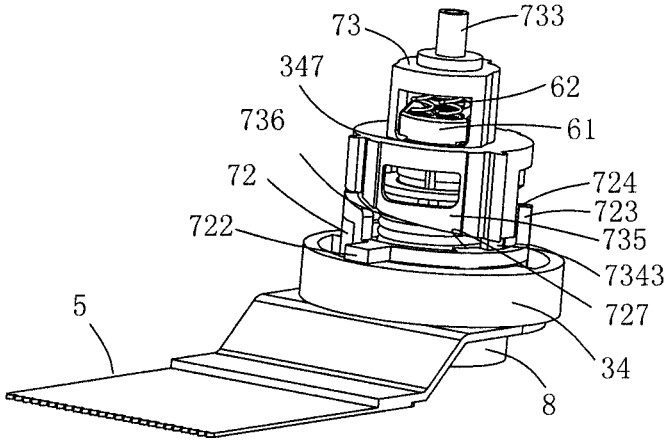
FIG. 7 shows a view of the part of the power tool shown in FIG. 2 in a second position, while the locking mechanism is between the released position and a locking position.
Figure 8:
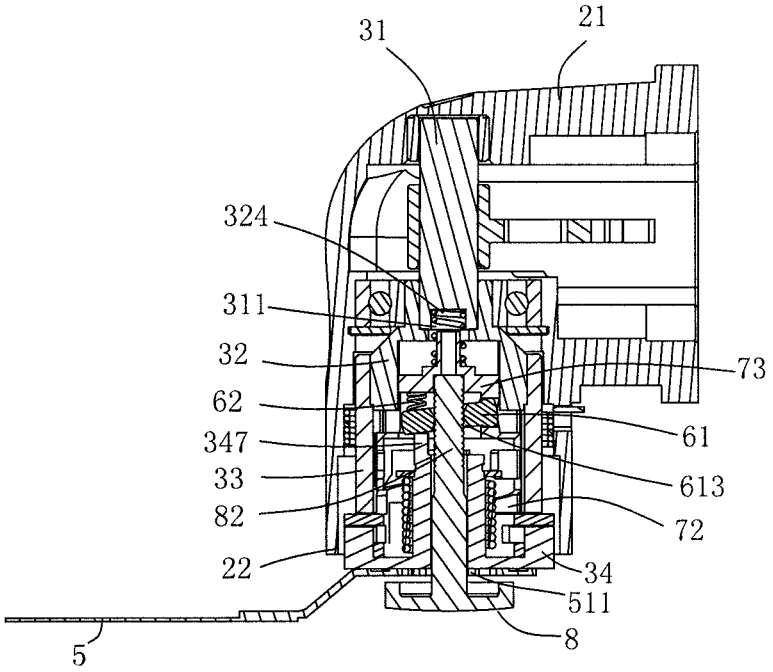
FIG. 8 shows a sectional view of the part of the power tool shown in FIG. 7.

FIGS. 7 and 8 are schematic views of the oscillating tool 100 at the second position, wherein the locking mechanism 6 is located between the locking position and the releasing position, and the fixing element 8 is not completely locked by the locking mechanism 6. A user presses the plate 81 of the fixing element 8, and then the top of the rod portion 82 drives the driven unit 73 to overcome the spring force of the third elastic unit 324 to axially move upward by a certain distance. The driven unit 73 also drives the locking mechanism 6 to move upward. By the effect of the spring force of the second elastic unit 62, only the head portion 611 of the locking unit 61 moves axially upward such that the locking unit 61 axially inclines relative to the axis of the output shaft 3, but at this position one end of the locking unit 61 opposite to the head portion 611 is not completely separated from the block portion 347 of the shaft base 34, so the locking unit 61 does not completely lock the rod portion 82 of the fixing element 8.

In addition, at the second position, the driven unit 73 moves axially upward by a certain distance, but the second stop 7343 of the driven unit 73 is not completely axially separated from the first stop 727 of the driving unit 72, so the second stop 7343 still can limit the first stop 727. Therefore, although the lower surface 7342 of the driven unit 73 is separated from the upper surface 724 of the driving unit 72, the driving unit 72 still cannot rotate by the effect of the clockwise torsional force of the first elastic unit 726. In such circumstances, the first meshing surface 725 of the driving unit 72 and the second meshing surface 736 of the driven unit 73 form a certain space in the axial direction.

Figure 9:
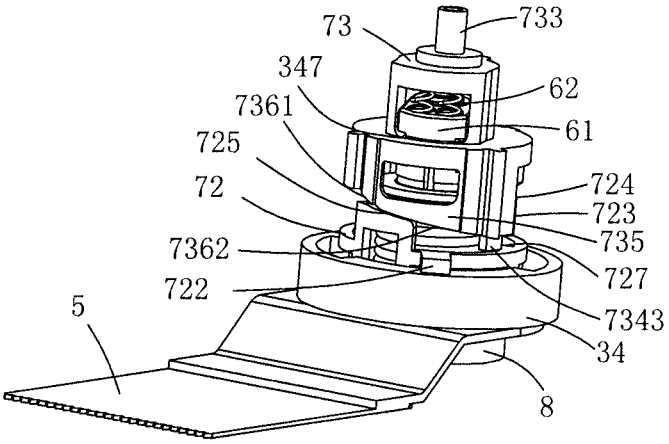
FIG. 9 shows a view of the part of the power tool shown in FIG. 2 in a third position, while the locking mechanism is in the locking position and the working head is not yet clamped.
Figure 10:
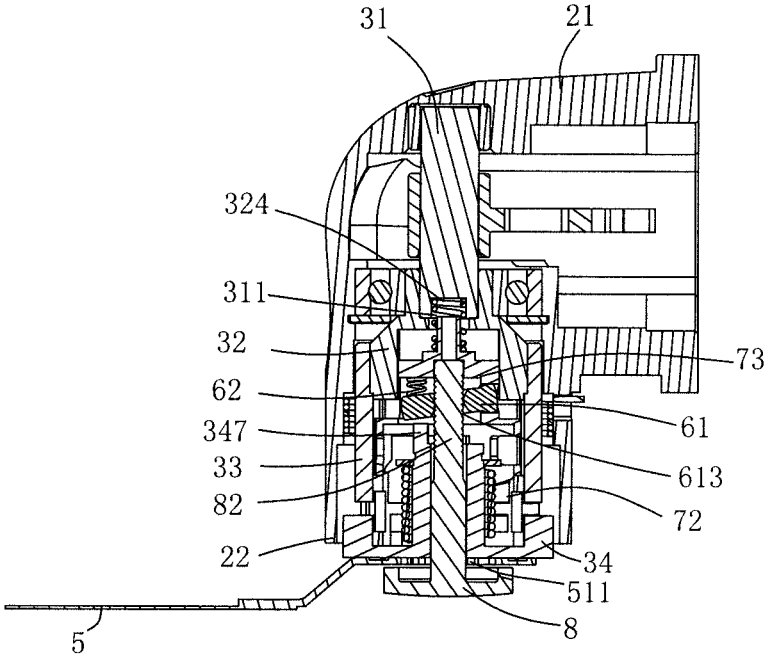
FIG. 10 shows a sectional view of the part of the power tool shown in FIG. 9.

FIGS. 9 and 10 are schematic views of the oscillating tool 100 at the third position, wherein the locking mechanism 6 is located at the locking position, and the fixing element 8 is completely locked by the locking mechanism 6. The fixing element 8 is further pushed upward and drives the driven unit 73 to further axially move upward such that the second stop 7343 of the driven unit 73 is axially separated from the first stop 727 of the driving unit 72.

The driving unit 72 starts rotating anticlockwise by the effect of the torsional force of the first elastic unit 726 after the radial resistance applied by the driven unit 73 is removed. The first meshing surface 725 of the driving unit 72 first quickly contacts the fast section 7361 of the second meshing surface 736 of the driven unit 73. The fast section 7361 has a relatively large lift angle, so the driven unit 73 can be driven to fast and quickly move upward to eliminate the axial spacing between the plate 81 of the fixing element 8 and the mounting portion 51 of the working head 8 after the first meshing surface 725 is mated with the fast section 7361 of the second meshing surface 736. After sliding through the fast section 7361 of the driven unit 73, the first meshing surface 725 of the driving unit 72 continues to rotate anticlockwise and is mated with the slow section 7362 of the driven unit 73 to further eliminate the axial spacing between the plate 81 of the fixing element 8 and the mounting portion 51 of the working head 5. At the third position, there is still a certain axial spacing between the plate 81 of the fixing element 8 and the mounting portion 51 of the working head 5. In such circumstances, the plate 81 of the fixing element 8 does not extrude the mounting portion 51 of the working head 5, and the working head 5 is still axially clamped.

Figure 11:
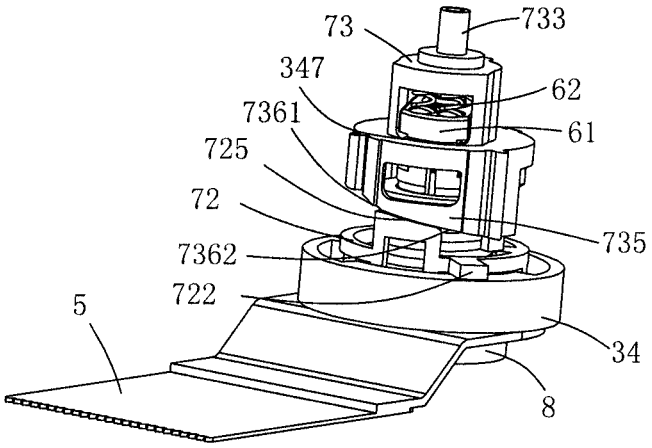
FIG. 11 shows a view of the part of the power tool shown in FIG. 2 in a fourth position, while the locking mechanism is in the locking position and the working head is clamped.
Figure 12:
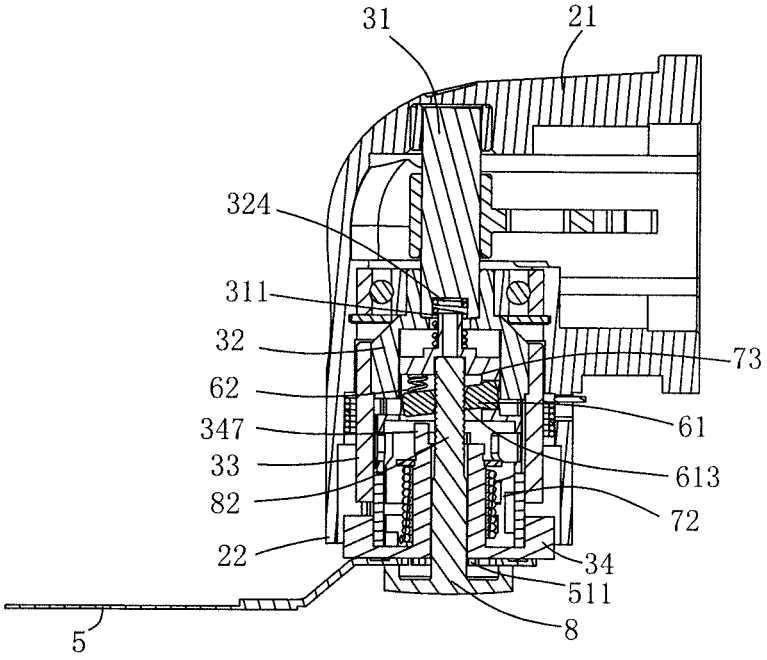
FIG. 12 shows a sectional view of the part of the power tool shown in FIG. 11.

FIGS. 11 and 12 are schematic views of the oscillating tool 100 at the fourth position, wherein the locking mechanism 6 is located at the locking position; the fixing element 8 is completely locked by the locking mechanism 6; and the working head 5 is axially clamped by the fixing element 8. By the torsional force of the first elastic unit 726, the driving unit 72 further rotates anticlockwise such that the plate 81 of the fixing element 8 tightly presses the mounting portion 51 of the working head 5 to axially fix the working head 5. After the axial spacing between the mounting portion 51 of the working head 5 and the plate 81 of the fixing element 8 is completely eliminated, the rod portion 82 of the fixing element 8 is clamped by the locking unit 61, so the driving unit 72 stops rotating. In such circumstances, the first meshing surface 725 of the driving unit 72 is meshed with the slow section 7362 of the second meshing surface 736 of the driven unit 73. In this embodiment, the first lift angle of the first meshing surface 725 is relatively small, set as 9 degrees, thus realizing self-locking and preventing the working head 5 from loosening when receiving a large axial load.

It should be pointed out that, in this embodiment, the first lift angle of the first meshing surface 725 of the driving unit 72 is not limited to 9 degrees; the driving unit 72 is made of steel or iron, and the friction coefficient of the first meshing surface 725 is in the scope of 0.1-0.15, so self-locking can be implemented when the first lift angle is in the scope of 11-17 degrees. Obviously, when the driving unit 72 is made from other materials, the scope of the first lift angle may correspondingly change.

The clamping process of the oscillating tool 100 in this embodiment is described in detail above, and the releasing process is reverse to the clamping process. When the working head 5 is required to be dismantled from the output shaft 3, the lever 712 of the driving element 71 is manually pulled such that the driving element 71 rotates clockwise; after the driving element 71 rotates a certain angle, the gaps 713 interfere with the projecting portions 722 of the driving unit 72 so as to drive the driving unit 72 to rotate clockwise. When the driving unit 72 rotates relative to the driven unit 73, the first meshing surface 725 is separated from the slow section 7362 and the fast section 7361 of the second meshing surface 736 in sequence, so the driven unit 73 axially moves downward by the effect of the spring force of the third elastic unit 324 until the lower surface 7342 of the driven unit 73 is pressed against the upper surface 724 of the driving unit 72.

When the driven unit 73 axially moves downward, the locking mechanism 6 is driven to axially move downward. During the downward movement of the locking unit 61, one end of thereof opposite to the head portion 611 is stopped by the block portion 347 of the shaft base 34 such that the locking unit 61 is finally located at a horizontal position vertical to the axis X of the output shaft 3 so as to release the fixing element. Meanwhile, when the driven unit 73 moves downward, the fixing element 8 is driven to move downward and finally pushed out of the output shaft 3 by a certain distance, so the fixing element 8 can be easily taken out from the output shaft 3.

In conclusion, the power tool 100 in this embodiment is provided with the driving mechanism 7 having the driving unit 72 and the driven unit 73, and the driving unit 72 and the driven unit 73 are respectively provided with a first meshing surface 725 and the second meshing surface 736, which are mutually mated. When the driving unit 72 rotates around the axis X of the output shaft 3 in a reciprocating way, the two meshing surfaces can be mated to drive the driven unit 73 to axially move up and down, so the locking mechanism 6 locks or releases the fixing element 8. This structure brings convenience to operation. Moreover, self-locking can be implemented after the lift angle of the first meshing surface 725 is set in a certain scope, thus ensuring the stability of the working. In addition, through arrangement of a elastic unit between the driving unit and the output shaft, the driving unit can automatically rotate from the releasing position back to the locking position when the fixing element is installed, thus saving operation steps.

Embodiment 2

Figure 13:
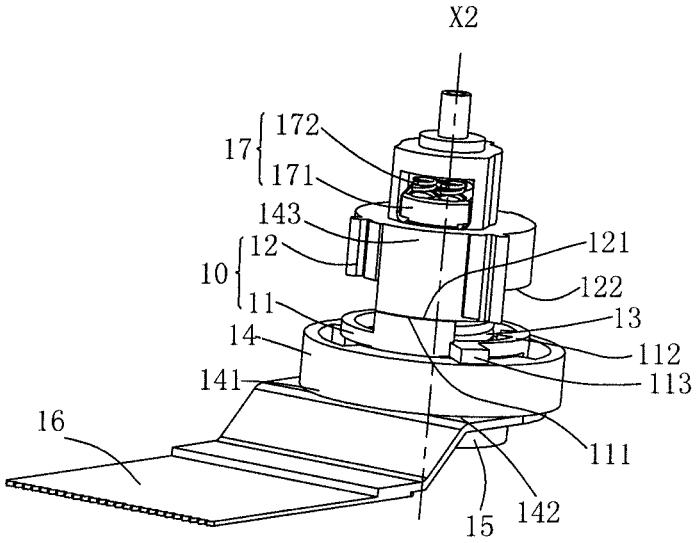
FIG. 13 shows a view of the part of the power tool according to a second embodiment of the disclosure in a first position, while the locking mechanism is in a locking position.
Figure 14:
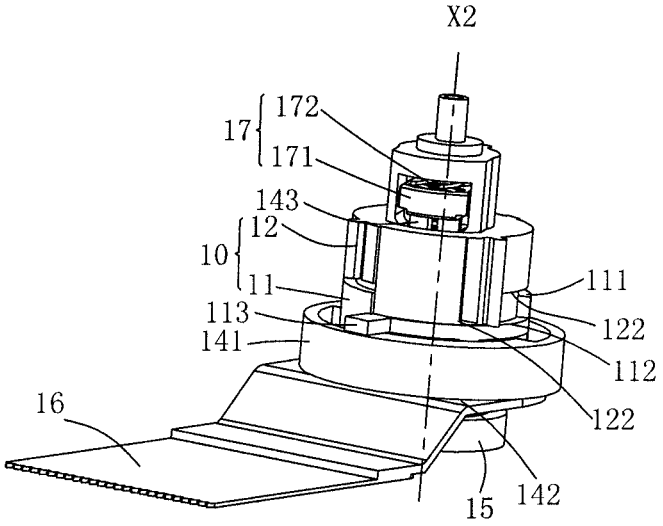
FIG. 14 shows a view of the part of the power tool shown in FIG. 13 in a second position, while the locking mechanism is in a released position.

The following are description of the second embodiment of the present disclosure with reference to FIGS. 13 and 14. This embodiment also specifically relates to an oscillating tool, different from the oscillating tool 100 in the first embodiment in a driving mechanism 10 and identical with the first embodiment in all other parts. The driving mechanism 10 comprises a driving unit 11, a driven unit 12 mated with the driving unit 11 and a first elastic unit 13. This oscillating tool also comprises an output shaft 14, a fixing unit 15 and a working head 16 installed at the output shaft 14 through the fixing unit 15, and a locking mechanism 17 received in the driving unit 12. The output shaft 14 is provided with a shaft base 141; the driving unit 11 is installed in the shaft base 141; and the driving unit 12 is axially arranged above the driving unit 11. The tail end of the shaft base 141 is provided with a carrier 142, and the working head 16 is clamped between the carrier 142 and the fixing unit 15. The locking mechanism 17 also comprises a locking unit 171 and a second elastic unit 172 installed between the locking unit 171 and the driven unit 12. By the effect of the driving mechanism 10, the locking mechanism 17 can move between the locking position and the releasing position so as to clamp or release the fixing unit 15. In addition, a third elastic unit (not shown in the figure) is axially arranged between the driven unit 12 and the output shaft 14. When the fixing unit 15 is installed in the output shaft 14, the driven unit 12 is driven to overcome the spring force of the third elastic unit and axially move upward.

Identical with the first embodiment, the driving mechanism 10 also can enable the locking mechanism 17 to switch between the locking position and the releasing position without assistance of other auxiliary tools, and can rigidly support the locking mechanism 17 at the releasing position such that the distance between the locking mechanism 17 and the carrier of the output shaft 14 cannot be compressed. Then, the locking mechanism 17 and the fixing unit 15 are prevented from axially moving downward as a whole on condition of a relatively large load and thereby loosening the working head 16, thus ensuring stability of the whole tool and improving the working efficiency of the working head 16.

The driving unit 11 is provided with a first meshing surface 111, and the driven unit 12 is provided with a second meshing surface 121 mated with the first meshing surface 111. Different from the first embodiment, both the first meshing surface 111 and the second meshing surface 121 are planes and vertical to the axis X2 of the output shaft 14. The driving unit 11 is also provided with a recess portion 112. The first recess portion 112 and the first meshing surface 111 are axially located at different altitudes. The driven unit 12 is corresponding provided with a second recess portion 122 mated with the first recess portion 112. The second recess portion 122 and the second meshing surface 121 are also axially located at different altitudes. In addition, the driving unit 11 is also provided with a projecting portion 113 for external force application. Through the projecting portion 113, the driving unit 11 can be driven to rotate around the axis X2.

As shown in FIG. 13, the locking mechanism 17 is located at the locking position. In such circumstances, the first meshing surface 111 of the driving unit 11 and the second meshing surface 121 of the driven unit 12 just face each other and are meshed, and the driven unit 12 is supported by the driving unit 11 at a relatively high axial position. The locking unit 171 is located at a position and inclined relative to the axis X2 by the effect of the second elastic unit 172 so as to clamp the fixing unit 15. At this position, through the projecting portion 113, the driving unit 11 is driven to clockwise rotate a certain angle such that the first meshing surface 111 and the second meshing surface 121 are disengaged. By the effect of the third elastic unit, the driven unit 12 axially moves downward such that the locking mechanism 17 switches from the locking position to the releasing position.

As shown in FIG. 14, the locking mechanism 17 is located at the releasing position. At this position, the first meshing surface 111 and the first recess portion 112 of the first driving unit 11 are respectively meshed with the second meshing surface 121 and the second recess portion 122 of the driven unit 12, and the driven unit 12 is supported by the driving unit 11 at a relatively low axial position. Although stressed by the spring force of the first elastic unit 13, the driving unit 11 is limited by the driven unit 12 and still cannot rotate anticlockwise. The locking unit 171 is stopped by a block portion 143 on the shaft base 141 and rotates to a horizontal position vertical to the axis X2 so as to release the fixing unit 15. Then, the fixing unit 15 can be moved out of the output shaft 14, and the finally the working head 16 can be dismantled.

To install the working head 16, install the working head 16 at the carrier 142 of the output shaft 14 first, penetrate the fixing unit 15 through the working head 16, insert the fixing unit into the output shaft 14, and finally press the fixing unit 15 against the driven unit 12. Continuously press the fixing unit 15 in the axial direction to drive the driven unit 12 to overcome the spring force of the third elastic unit and axially move by a certain distance, so that the second meshing surface 121 and the second recess portion 122 of the driven unit 12 are disengaged with the first meshing surface 111 and the first recess portion 112 of the driving unit 11. Finally, the driven unit 12 and the driving unit 11 are axially separated; the driving unit 11 rotates anticlockwise and automatically returns to the original position thereof by the effect of the spring force of the first elastic unit 13; the locking mechanism 17 returns from the releasing position back to the locking position to clamp the fixing unit 15 and steadily fix the working head 16 at the output shaft 14.

From the above, it can be known that the driving mechanism 10 of the oscillating tool in this embodiment can enable the locking mechanism 17 to switch between the locking position and the releasing position without other auxiliary tools, so the working head 16 can be installed or dismantled conveniently. In addition, at the locking position, the driving unit 11 provides rigid support for the driven unit 12, and the locking mechanism 17 is installed in the driven unit 12 and therefore is rigidly supported by the driven unit 10, thus preventing the working head 16 from loosening and slippage on condition of bearing a large load.

Obviously, in this embodiment, the locking mechanism 17 is also not limited to the locking unit 171 and the second elastic unit 172. Those skilled in the field can also easily figure out other structures, such as the solutions employed in the description of the related art, which are not described repeatedly here.

Embodiment 3

In the first and second embodiments, the driving units of the driving mechanism both rotate around the axis of the output shaft so as to drive the driven unit to axially move, so the driving mechanism moves the first mating position and the second mating position. However, the present disclosure is not limited to the above structures. The driving mechanism of the present disclosure may also employ other structures. For example, the driving unit rotates around the straight line vertical to the axis of the output shaft. The third embodiment of the present disclosure is described with reference to FIGS. 15-19.

Figure 15:
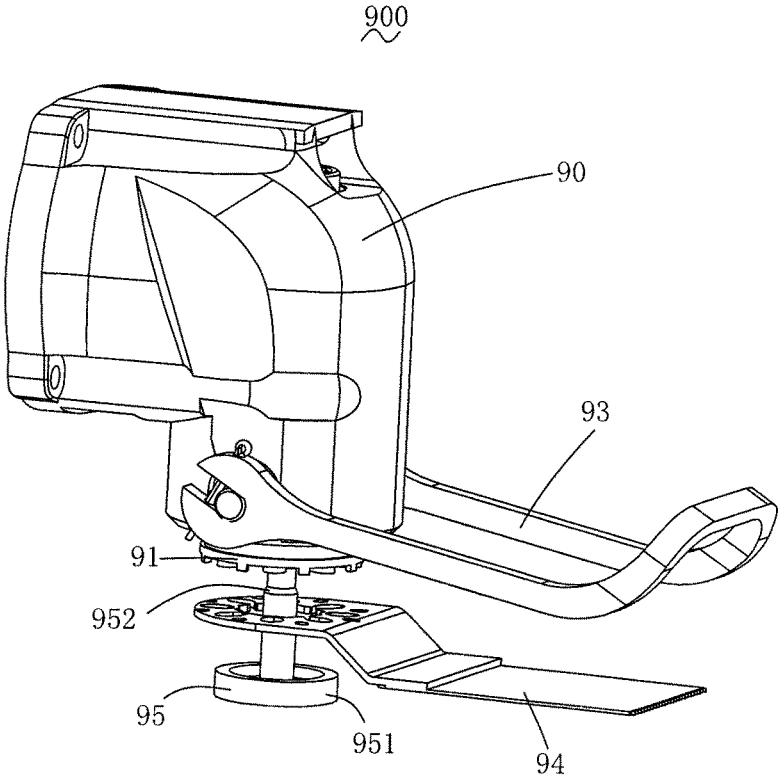
FIG. 15 shows a view of the part of the power tool according to a third embodiment of the disclosure in a first position, while the locking mechanism is in a released position.
Figure 17:
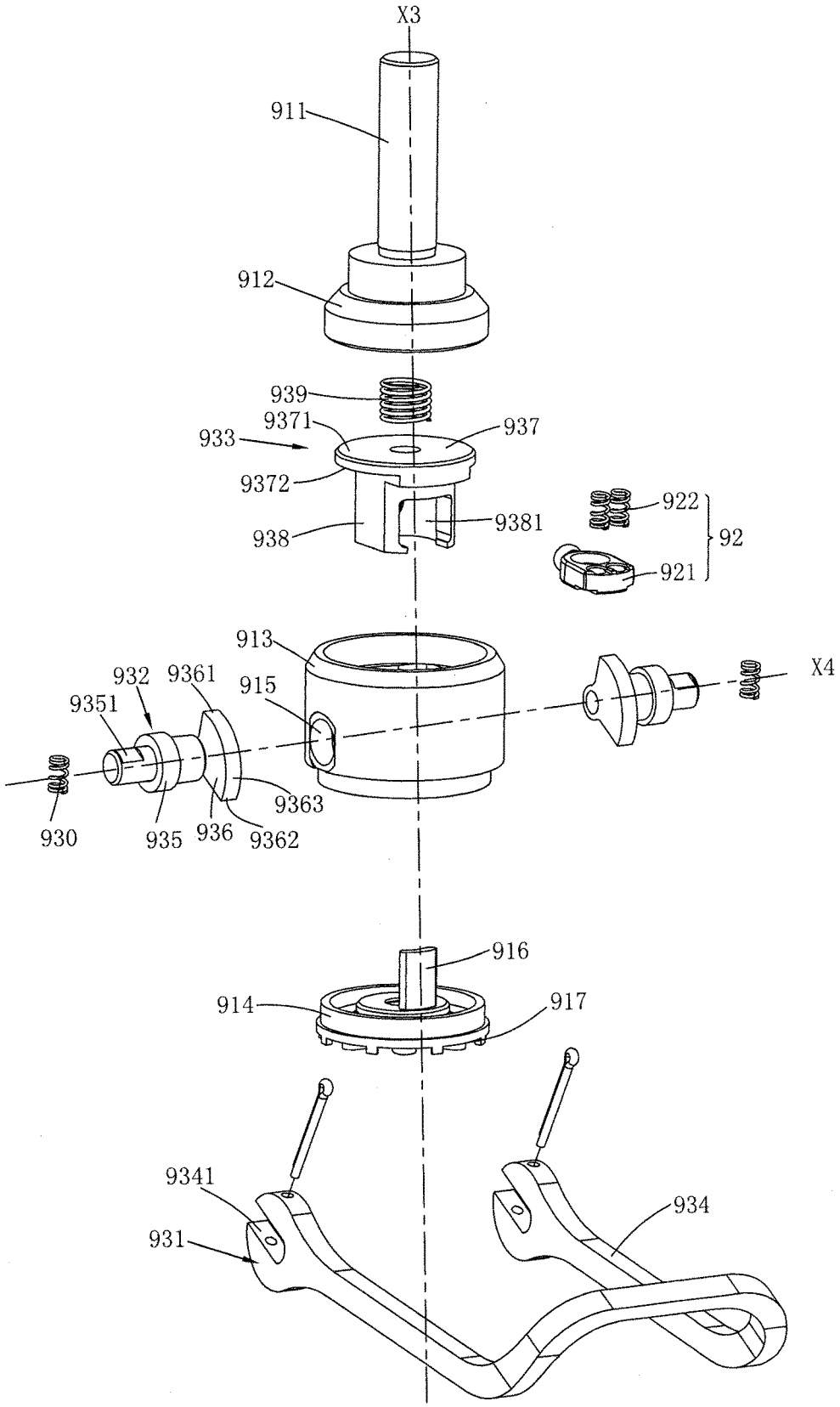
FIG. 17 shows a three-dimensional exploded view of a portion of the power tool shown in FIG. 15.

As shown in FIGS. 15 and 17, this embodiment specifically provides an oscillating tool 900, comprising a head cover 90, an output shaft 91 and a locking mechanism 92 installed in the head cover 90, a driving mechanism 93 for driving the locking mechanism 92 to move between the locking position and the releasing position, a working head 94 and a fixing element 95 for fixing the working head 94 at the tail end of the output shaft 91. The driving mechanism 93 can switch between the first mating position and the second mating position so as to drive the locking mechanism 92 to move between the locking position and the releasing position. The driving mechanism 93 is also provided with a first elastic unit 930. When the locking mechanism 92 moves from the releasing position to the locking position, the first elastic unit 930 drives the driving mechanism 93 to automatically return from the second mating position to the first mating position.

Figure 16:
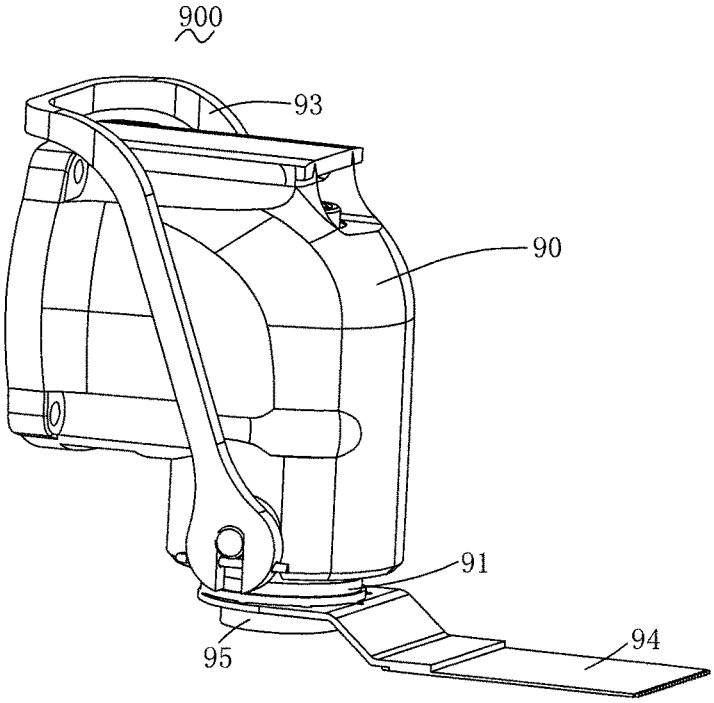
FIG. 16 shows a view of the part of the power tool shown in FIG. 15 in a second position, while the locking mechanism is in a locking position.

As shown in FIG. 15, the fixing element 95 has a plate 951 and a rod portion 952 that axially extends upward from the center of the plate 951. At this moment, the driving mechanism 93 is located at the second mating position, and the locking mechanism 92 is located at the releasing positions; the rod portion 952 of the fixing element 95 is not clamped by the locking mechanism 92, and the fixing element 95 can be moved out of the output shaft 91 so as to dismantle the working head 94. As shown in FIG. 16, the driving mechanism 93 is located at the first mating position, and the locking mechanism 92 is located at the locking position. The rod portion 952 of the fixing element 95 is clamped by the locking mechanism 92 so as to steadily clamp the working head 94 between the output shaft 91 and the fixing element 95.

This embodiment is approximately the same as the former two embodiments in the locking mechanism, the fixing element and the working head, and mainly different in the driving mechanism and the output shaft. As shown in FIG. 17, in this embodiment, the output shaft 91 has an axis X3 and specifically comprises a shaft body 911, a shaft cap 912, a shaft sleeve 913 and a shaft base 914, which are arranged in sequence in the axial direction, wherein the shaft sleeve 913 is approximately hollow and cylindrical, and the two sides of the shaft sleeve 913 are symmetrically provided with two through holes 915. The shaft base 914 is provided a stop 916 that protrudes and extends axially, the bottom of the shaft base 914 being used to install a carrier 917 of the working head 94. The locking mechanism 92 specifically comprises a locking unit 921 and a second elastic unit 922 supported at one end of the locking unit 921, and the middle part of the locking unit 921 is provided with a locking bore 923.

The driving mechanism 93 specifically comprises a driving element 931, driving units 932 and a driven unit 933. The driving units 932 and the driven unit 933 are arranged between the locking mechanism 93 and the carrier 917 of the output shaft 93, and the first elastic unit 930 is connected to the driving units 932. Operating the driving element 931 can drive the driving unit 932 to pivot around the straight line vertical to the axis X3 of the output shaft 91, and then the driving unit 932 drives the driven units 933 to axially move up and down.

The driving element 931 is approximately U-shaped, has two opposite arm portions 934. The free end of each arm portion 934 is provided with a U-shaped groove 9341. The driving unit 932 has an axis X4 vertical to the axis X3, comprising a cylindrical shaft portion 935 extending along the axis X4 and a cam portion 936 connected to one end of the shaft portion 935. The other end of the shaft portion 935 opposite to the cam portion 936 is processed to form a flat square portion 9351 received in the U-shaped groove 9341 of the driving element 931. The cam portion 936 is approximately sector shaped and plate-like vertical to the axis X4 and has a lower end 9361 close to the axis X4 and a top end 9362 far away from the axis X4. The lower end 9361 and the top end 9362 jointly form a first meshing surface 9363 and the first meshing surface 9363 is a cam surface.

In this embodiment, there are two driving units 932, arranged symmetric to the axis X3. During assembling, two shaft portions 935 are installed in the through holes 915 on two sides of the shaft sleeve 913 and can rotate around the axis X4, and the two cam portions 936 are received in the shaft sleeve 913. The two flat square portions 9351 of the driving units 932 are respectively received in the groove 9341 such that when the driving element 931 is rotated, the square flat portions 9351 are mated with the groove 9341 to drive the driving units 932 to rotate. A first elastic unit 930 is arranged between each driving unit 932 and the shaft base 914. When the driving mechanism 93 is located at the second mating position, the first elastic units 930 are stretched by a certain length by the driving units 932 such that the driving mechanism 93 automatically returns from the second mating position back to the first mating position.

The driven unit 933 is received in the shaft sleeve 913 and axially located above the cam portions 936 of the driving units 932. The driven unit 933 is approximately T-shaped, comprising a plate-like mating section 937 on the top and a receiving section 938 below the mating section 937. The mating section 937 is vertical to the axis X3. The cross section vertical to the axis X3 is round, having two sides respectively protruding by a certain distance relative to the receiving section 938 so as to form meshing portions 9371, which are respectively mated with the cam portions 936 of the driving units 932. The two meshing portions 9371 are respectively axially supported above the cam portions 936 of the driving units 932. The bottoms of the meshing portions 9371 are formed with second meshing surfaces 9372 mated with the first meshing surface 9363 of the cam portions 936. In this embodiment, the second meshing surfaces 9372 specifically are planes vertical to the axis X3. The receiving section 938 is hollow and cylindrical, internally provided with a receiving cavity 9381 for receiving the locking mechanism 92.

In addition, the driving mechanism 93 also comprises a third elastic unit 939 arranged between the driven unit 933 and the shaft cap 912 of the output shaft 91 such that the driven unit 933 can move axially when driven by an outer force. In this embodiment, when the driving mechanism 93 moves from the open position to the closed position, the driven unit 933 can be driven through the rotation of the driving units 932 to overcome the spring force of the third elastic unit 939 to move upward. When the driving mechanism 93 is located at the open position, the fixing element 95 can be pressed to push the driven unit 933 to axially move upward.

The installation and dismantling processes of the working head 94 in this embodiment are described in details below with reference to FIGS. 18 and 19. In use, the driven unit 931 is pulled to anticlockwise rotate around the axis X4 to driven the entire driving mechanism 93 to move between the open position and the closed position, so that the locking mechanism 92 is driven to switch between the releasing position and the locking position to release or lock the fixing element 95 for dismantling or installing the working head 94. When the driving element 931 rotates, mating between the groove 9341 and the flat square portions 9351 drives the driving units 932 to rotate, so the meshing positions between the first meshing surfaces 9363 of the driving units 932 and the second meshing surface 9372 of the driven unit 933 slide from the lower ends 9361 to the top ends 9362 of the cam portions 936 so as to axially support the driven unit 933 and axially move the driven unit 933 upward, and then the locking mechanism 92 moves from the releasing position to the locking position. The process that the locking mechanism 92 moves from the locking position to the releasing position is opposite, and just pull the driving element 931 anticlockwise when the driving mechanism 93 is located at the closed position.

Figure 18:
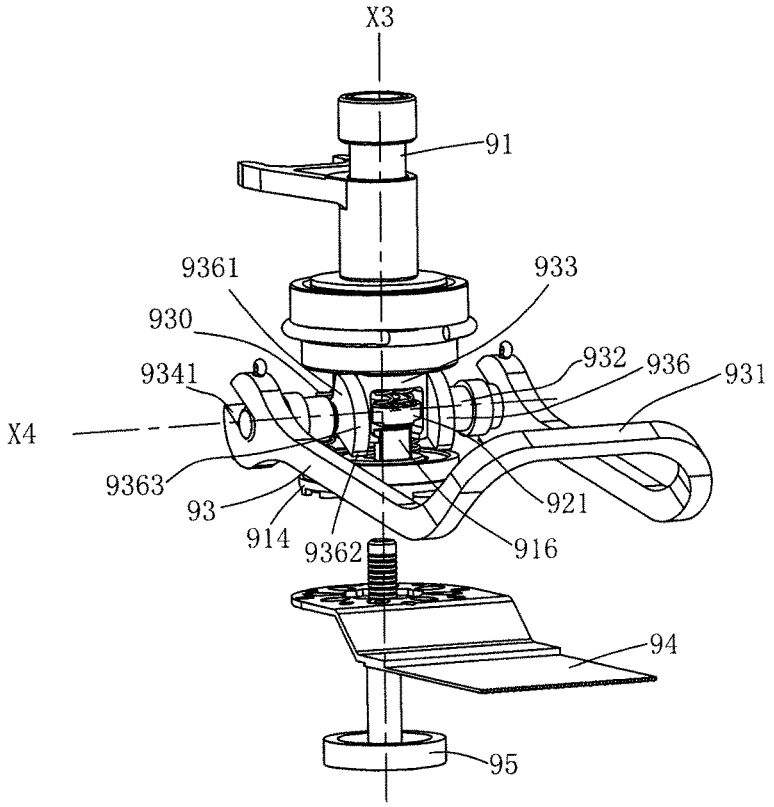
FIG. 18 shows a structural view of the part of the power tool in the first position shown in FIG. 15.

With reference to FIG. 18, the driving mechanism 93 is located at the second mating position; the locking mechanism 92 is located at the releasing position; the rod portions 952 of the fixing element 95 is not clamped, so the fixing element 95 can be moved out of the output shaft 91 to install the working head 94. At this position, the driving element 931 is approximately vertical to the output shaft 91, and the lower ends 9361 of the cam portions 936 of the driving units 932 support the meshing portion 9371 of the driven unit 933. By the effect of the third elastic unit 939, the driven unit 933 axially moves downward to a relatively low position such that the locking mechanism 92 is located at the releasing position. At this position, the locking unit 921 is stopped by the block portion 916, compresses the second elastic unit 922, moves to the horizontal position vertical to the axis X3, and then releases the rod portion 952 of the fixing element 95. At this time, the rod portion 952 of the fixing element 95 can be inserted into the output shaft 91 or dismantled from the output shaft 91 so as to install or dismantle the working head 94.

Figure 19:
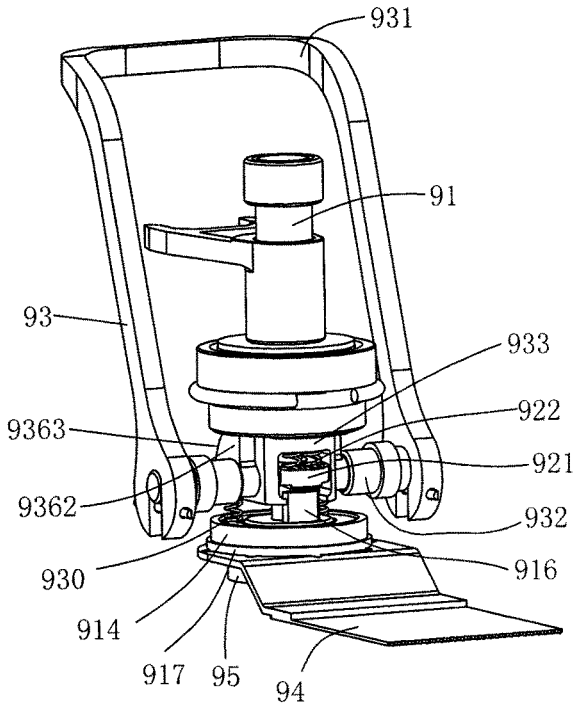
FIG. 19 shows a structural view of the part of the power tool in the second position in FIG. 15.

Referring to FIG. 19, during installation of the working head 94, the fixing element 95 is required to be inserted into the output shaft 91. In the process of the axial insertion, the fixing element 95 pushes the driven unit 933 to axially move upward by a certain distance. At this moment, by the effect of the pulling force of the first elastic unit 930, the driving units 932 automatically anticlockwise rotate to drive the driving element 931 to anticlockwise rotate approximate 90 degrees such that the driving mechanism 93 moves from the second mating position to the first mating position as shown in FIG. 18 and finally the locking mechanism 92 is located at the locking position. In such circumstances, the locking mechanism 92 is rigidly supported by the driving mechanism 93, and the distance between the locking mechanism 92 and the carrier 917 of the output shaft 91 is kept unchanged. In addition, the rod portion 952 of the fixing element 95 is clamped, and the working head 94 is steadily clamped between the plate 951 of the fixing element 95 and the shaft base 914 of the output shaft 91. During rotation, the driving element 931 drives the driving units 932 to anticlockwise rotate around the axis X4 thereof such that the first meshing surfaces 9363 of the cam portions 936 slip relative to the second meshing surface 9372 of the driven unit 933, and the meshing positions move from the lower ends 9361 to the top ends 9362 of the cam portions 936 in sequence, and then the driven unit 933 overcomes the spring force of the second elastic unit 922 and moves axially upward by a certain distance. The driven unit 933 also drives the locking mechanism 92 to move upward such that the locking unit 921 is disengaged with the stop 916 and by the effect of the third elastic unit 939 returns to the inclined position relative to the axis X3, thus clamping the rod portion 952 of the fixing element 95. When the driving mechanism 93 is located at the closed position, the top ends 9362 of the cam portions 936 of the driving units 932 support the second meshing surface 9372 of the driven unit 933. The first meshing surfaces 9363 are cam surfaces, so the first meshing surfaces 9363 and the second meshing surface 9372 form self-locking on certain conditions, thus preventing the fixing element 95 from loosening and steadily clamping the working head 94.

In this embodiment, through the movement of the driving mechanism 91 between the open position and the closed position, the locking mechanism 92 can switch between the releasing position and the locking position, so the working head 94 can be dismantled or installed without other auxiliary tools. In addition, the driving units 932 and the driven unit 933 in this embodiment are both made of rigid materials, so the locking mechanism 92 can be rigidly supported at the locking position, thus ensuring that the fixing element 95 will not get loose and steadily fixing the working head 94.

Through the above three embodiments, it can be understood that the power tool of the present disclosure mainly drives the driving mechanism to switch between the first mating position and the second mating position through arrangement of the driving units and the driven unit, which can move relative to each other so as to drive the locking mechanism to move between the locking position and the releasing position. At the locking position, the fixing element is clamped on the output shaft to fix and install the working head; at the releasing position, the fixing element can be dismantled from the output shaft to take down the working head from the output shaft. The driving units and the driven unit can be provided with the first meshing surface and the second meshing surface, which can be mutually mated; when the driving mechanism is located at the first mating position, the two meshing surfaces can form self-locking so as to steadily support the working head. The driving units can rotate relative to the driven unit. In such circumstances, the first meshing surface may be set as a cam surface, a plane, an inclined surface, or other curved surface capable of realizing self-locking.

In addition, the driving mechanism is also provided with the first elastic unit connected to the driving unit, which can drive the driving units to automatically return to the original position after movement, so that the driving mechanism can automatically drive the locking mechanism to move from the releasing position back to the locking position under certain conditions.

It should be pointed out that the power tool of the present disclosure is not limited to the above embodiments, and the driving mechanism is not limited to metal materials and may be made of nonmetallic materials. The driving unit is also not limited to rotation relative to the driven unit, and may translate relative to the driven unit as long as it can move on in the axial direction of the driven unit. In addition, the driving unit or the driven unit is also not limited to the situation of being respectively provided with the first meshing surface and the second meshing surface. Either the driving unit or the driven unit is provided with the first meshing, and the other can be provided with a spot or line mated with the meshing surface.

Embodiment 4

Figure 20:
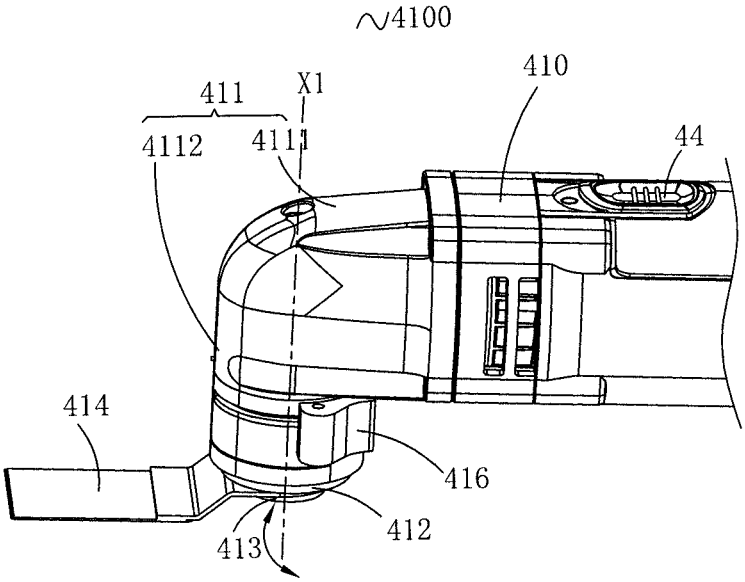
FIG. 20 shows a three-dimensional view of the power tool according to a fourth embodiment of the disclosure.
Figure 21:
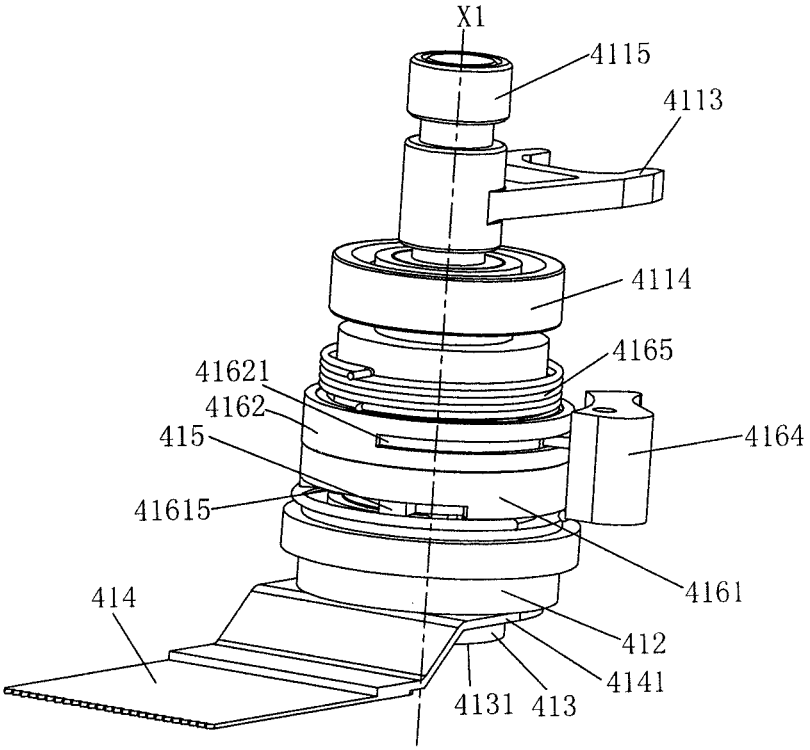
FIG. 21 shows a three-dimensional view of the part of the power tool shown in FIG. 20.

Referring to FIGS. 20 and 21, a power tool, specifically an oscillating tool 4100, comprises a housing 410 extending lengthwise, a head cover 411 connected to the front end (as shown in FIG. 20, the left side is defined as the front end) of the housing 410 and an output shaft 412 extending out of the head cover 411. Wherein, the housing 410 is internally provided with a motor (not shown in the figure). The housing 410 is also provided with a switch 413 to control the startup or shutdown of the motor. The head cover 411 comprises a horizontal portion 4111, which is connected with the housing 410 and is arranged along the horizontal direction as shown in FIG. 20, and a vertical portion 4112, which extends downward in an approximately vertical direction along the tail end of the horizontal portion 4111. The output shaft 412 is located in the vertical direction, having one end installed in the head cover 411 and the other end downward extending out of the vertical portion 4112 of the head cover 411. The output shaft can rotate in a reciprocating way around its own longitudinal axis X1 in a direction indicated by the double arrow in FIG. 20.

In addition, the head cover 411 is also internally provided with an eccentric element (not shown in the figure) and a fork assembly 4113, which are common elements used on the oscillator so as to convert the rotary output torque of the motor into the oscillation output torque of the output shaft 412. When rotating, the eccentric member converts its rotation by fit with the fork assembly 4113 into the oscillation of the output shaft 412 around its own axis X1, wherein the oscillation angle is approximate 0.5-7 degrees, and the oscillation frequency can be set to 5,000-30,000 turns/min. The free end of the output shaft 412 can be equipped with a working head 414 through a fixing element 413. In this embedment, the working head 414 is a kind of straight saw blade. The working head 414 can be driven by the output shaft 412 to oscillate along the direction indicated by the dual arrow in FIG. 20.

In comparison with the rotary type power tool, when the oscillation tool 4100 is working, the output shaft 412 rotates and oscillates around its own axis X1 in a reciprocating way such that large breaking torques are generated along the two oscillation directions. Therefore, a huge axial holding force is needed to ensure that the head 414 is fixed on the output shaft 412 under all working conditions, and avoid slippage so as to guarantee the working efficiency or normal regular work.

Figure 22:
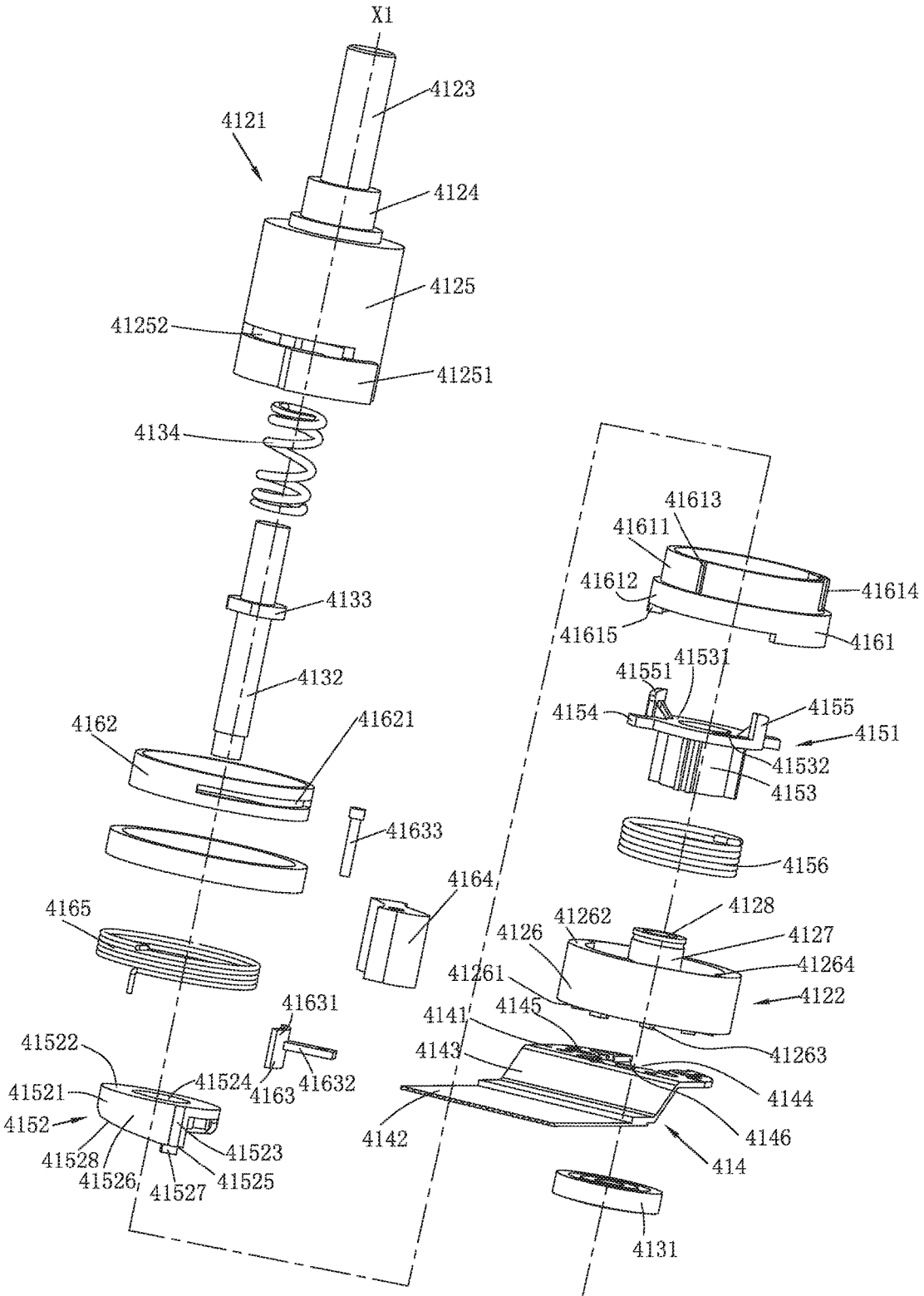
FIG. 22 shows a three-dimensional exploded view of the part of the power tool shown in FIG. 21.
Figure 23:
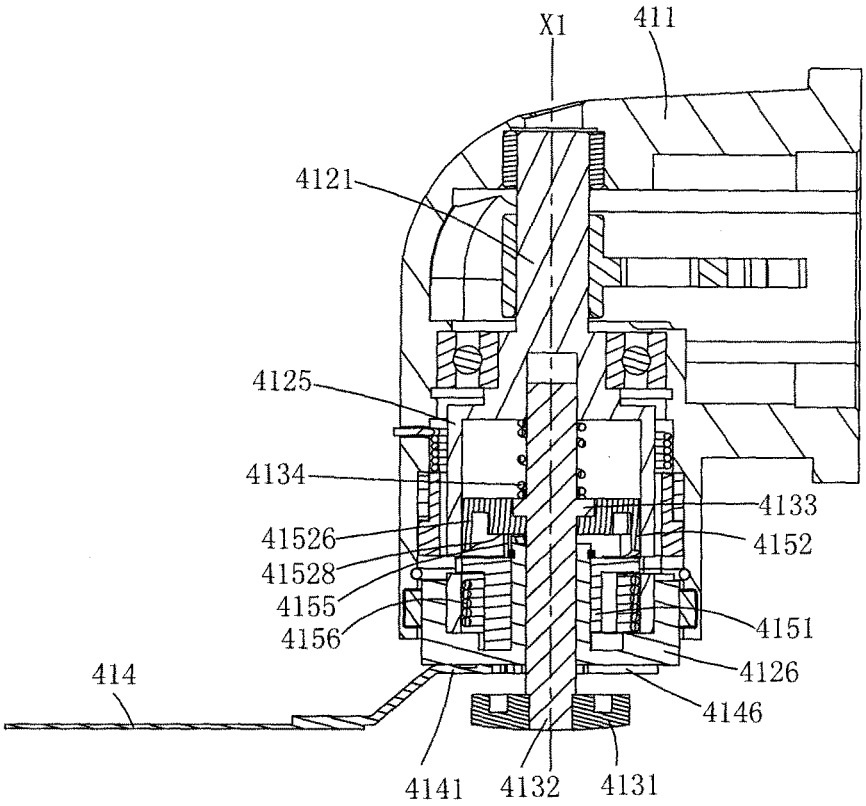
FIG. 23 shows a three-dimensional view of the part of the power tool shown in FIG. 21 in a first status, while the driving mechanism is in a second mating position.

As shown in FIGS. 21-23, the direction of the straight line where the axis X1 of the output shaft 412 exists is defined as the lengthwise direction, while the direction vertical to the axis X1 is defined as the crosswise direction; the bottom of the paper is downward, and the top of the paper is upward. The following descriptions all employ such definition. The oscillating tool 4100 comprises a driving mechanism 415 arranged in the head cover 411. The fixing element 413 comprises a pressing portion 4131 arranged relative to the tail end of the output shaft 412. The driving mechanism 415 can move between the first mating position and the second mating position. At the first mating position, the driving mechanism drives the pressing portion 4131 of the fixing element 413 to press the working head 414 at the output shaft 412; and at the second mating position, the driving mechanism drives the pressing portion 4131 to keep a clearance with the working head 414 so as to release the working head 414 from the output shaft 412. Through the above structure, the fixing element 413 can quickly press or release the working head 414 so as to quickly install or dismantle the working head 414.

The output shaft 412 is used to transmit the output torque to the working head 414. The output shaft 412 is hollow, received in the vertical portion 4112 of the head cover 411 and axially supported between a ball bearing 4114 and a sleeve bearing 4115, which are installed in the head cover 411 in parallel. In this embodiment, the output shaft 412 is split-type, specifically comprising a shaft body 4121 and a shaft base 4122 connected below the shaft body 4121. The shaft body and the shaft base cannot rotate relative to each other to transmit the rotation torque. Wherein, the shaft body 4121 is divided into three sections: top section 4123, middle section 4124 and bottom section 4125. The three sections are all cylindrical and diameters thereof increase one by one from the top down. The sleeve bearing 4115 is installed on the top section 4123, and the ball bearing 4114 is installed on the middle section 4124. The bottom section 4125 is hollow. One end far away from the middle section 4124 radially protrudes and extends to form two symmetric ears 41251, and a narrow guide groove 41252 is formed along the circumferential direction above the ears 41251.

The shaft base 4122 is located below the shaft body 4121 and has a carrier 4126. The carrier 4126 comprises a round footwall 41261, a hollow and cylindrical outer coat 41262, which axially extends upward from the outer edge of the footwall 41261, and several protruding posts 41263, which extend axially downward from the lower surface of the footwall 41261 and are arranged in circumferential way. The shaft base 4122 also comprises a hollow and cylindrical inner coat 4127, which extends upward from the middle part of the footwall 41261 of the carrier 4126, and a receiving bore 4128 penetrating through the footwall 41261 of the carrier 4126 and the inner coat 4127. The inner wall of the outer coat 41262 of the carrier 4126 is symmetrically formed with two axial recess grooves 41264 for just receiving the two ears 41251 of the two shaft body 4121. The recess grooves 41264 and the ears 41251 are mated to limit the relative rotation of the shaft body 4121 and the shaft base 4122 so as to transmit the rotation torque.

The head 414 is a straight saw blade. Those skilled in this field can easily figure out that the working head 414 may be other attachments such as the circular saw blade, sand tray and scrapper. The working head 414 may be transversely arranged and has a plate-like mounting portion 4141 installed at the output shaft 412, a cutting portion 4142 for cutting and a connecting portion 4143 located between the mounting portion 4141 and the cutting portion 4142. Wherein, the mounting portion 4141 is provided with a center hole 4144, and several mounting holes 4145 mated with the protruding posts 41263 of the output shaft 412 are arranged on the outer periphery of the center hole 4144. One end of the mounting portion 4141 away from the connecting portion 4143 is also formed with a gap 4146 communicating with the center hole 4144, so the working head 414 can penetrate through the fixing element 413 via the gap 4146 from one side of the output shaft 412 to be installed.

The fixing element 413 is used to press the working head 414 on the carrier 4126 of the output shaft 412 so as to fix the working head 414, or release the working head 414 so as to dismantle the working head 414 from the output shaft 412. The fixing element 413 penetrates through the receiving bore 4128 of the output shaft 412, is mated with the driving mechanism 415 and then axially moveably fixed relative to the output shaft 412. The fixing element 413 specifically comprises an annular pressing portion 4131 located at the bottom and a slim rod portion 4132 that axially extends upward from the middle part of the pressing portion 4131. The tail end of the rod portion 4132 is provided a clipping portion 4133 that protrudes and extends radially outward so as to be mated with the driving mechanism 415. In this embodiment, the pressing portion 4131 and the rod portion 4132 are split and detachably connected through screw threads. Obviously, the pressing portion 4131 and the rod portion 4132 may also be integrated.

During installation, the fixing element 413 is fixedly arranged relative to the driving mechanism 415. When switching between the first mating position and the second mating position, the driving mechanism 415 can drive the fixing element 413 to axially move up and down such that the pressing portion 4131 of the fixing element 413 presses or releases the working head 414.

The driving mechanism 415 comprises a driving unit 4151 and a mating unit 4152, which can move relative to each other. Move the driving unit 4151, and then the driving mechanism 415 can move and switch between the first mating position and the second mating position and further drive the fixing element 413 to axially move up and down, so that the pressing portion 4131 of the fixing element 413 presses or releases the working head 414. At the first mating position, the fixing element 413 can be supported by either the driving unit 4151 or the mating unit 4152 and then axially fixed. In this embodiment, the fixing element 413 is specifically supported by the mating unit 4152.

The following are detailed description of the specific structure of the driving mechanism 415 with reference to FIGS. 21-23. The driving mechanism 415 comprises the driving unit 4151 and the mating unit 4152 located above the driving unit 4151. The driving unit 4151 and the mating unit 4152 are both installed in the output shaft 412, specifically received in the receiving space that is formed by the shaft body 4121 and the shaft base 4122. The fixing element 413 is supported on the mating unit 4152. When rotating relative to the axis X1 of the output shaft 412, the driving unit 4151 drives the mating unit 4152 to move axially, and the mating unit 4152 further drives the fixing element 413 to move axially.

The driving unit 4151 is made of a rigid material, comprising a hollow and cylindrical body 4153, two projecting portions 4154 extending from the body 4153 and two first meshing portions 4155. The two projecting portions 4154 extend radially outward from the top of the body 4153 and then are inserted into the corresponding guide grooves 41252 on the shaft body 4121. The two projecting portions 4154 are arranged symmetric to the center of the axis X1. The body 4153 has a horizontal upper surface 41531. The two first meshing portions 4155 are formed by the axially upward extending upper surface 41531 of the body 4153 and are also symmetric to the center. The first meshing portions 4155 are close to the projecting portions 4154. The tops of the first meshing portions 4155 incline axially to form end face cams, and the tops are first meshing surfaces 41551. The first meshing surfaces 41551 gradually rise along the clockwise direction, respectively having a first lift angle. A first elastic unit 4156 is arranged between the driving unit 4151 and the outer coat 41262 of the shaft base 4122. One end of the first elastic unit 4156 is pressed against the outer coat 41262, and the other end is pressed against the driving unit 4151, so the driving unit 4151 can automatically return to the original position after rotation. In addition, the upper surface 41531 of the body 4153 is provided with a first stop 41532 to be mated with the mating unit 4152. When the driving mechanism 415 is located at the second mating position, although the driving unit 4151 is stressed by the torsional force of the first elastic unit 4156, the driving unit 4151 still cannot rotate by the effect of the first stop 41532. In this embodiment, the first stop 41532 specifically is a recess groove formed by the upper surface 41531.

The mating unit 4152 is also made of a rigid material, axially installed above the driving unit 4151. The mating unit 4152 is hollow, comprising a hollow and cylindrical base body 41521, a roof 41522 located above the base body 41521 and several ribs 41523 formed by the outward projecting and extending outside of the base body 41521. The inside wall of the bottom section 4125 of the shaft body 4121 is provided with recesses (not shown in the figure) corresponding to the ribs 41523. The ribs 41523 are received in the corresponding recesses such that the mating unit 4152 cannot rotate relative to the output shaft 412. The middle part of the roof 41522 is provided with a hollow recess 41524. The rod portion 4132 of the fixing element 413 axially penetrates through the recess 41524 of the mating unit 4152 from the top down. The clipping portion 4133 of the fixing element 413 is just received in the recess 41524 and supported by the recess 41524, so the fixing element 413 is supported by the mating unit 4152, and the mating unit 4152 can drive the fixing element 413 to move axially together.

The mating unit 4152 has a horizontal lower surface 41525, and has a lower end inclined from the lower surface 41525 to form two second meshing portions 41526, which are respectively mated with the first meshing portions 4155 of the driving unit 4151. The base body 41521 axially protrudes and extends downward from the lower surface 41525 to form a second stop 41527, which is mated with the first stop 41532 of the driving unit 4151 to limit the rotation of the driving unit 4151. The tops of the second meshing portions 41526 are axially inclined to form end face cams. The tops are second meshing surfaces 41528. The second meshing surfaces 41528 gradually rise anticlockwise and have second lift angles. The second lift angles are to the first lift angle of the driving unit 4151, so that the driving unit 4151 can steadily rotate relative to the mating unit 4152.

In this embodiment, the oscillating tool 4100 also comprises an operation mechanism 416. The operation mechanism 416 can be manually operated to drive the driving unit 4151 to rotate around the axis X1 relative to the mating unit 4152, so that the driving mechanism 415 moves between the first mating position and the second mating position. This operation mechanism 416 comprises a driving element 4161 installed at the output shaft 412, a guide element 4162 installed at the driving element 4161, a pushing rod 4163, a toggle 4164 connected to the pushing rod 4163, and a second elastic unit 4165 arranged between the driving element 4161 and the head cover 411. Manually push the toggle 4164, and then the toggle 4164 drives the driving element 4161 through the pushing rod 4163 to rotate relative to the guide element 4162.

The driving element 4161 is approximately hollow and cylindrical, sleeved on the lower section 4125 of the shaft body 4121, capable of rotating around the axis X1. The driving element 4161 comprises a first post body 41611, which is located on the upper part, and a second post body 41612, which is located at the lower part and has a bigger outer diameter. The outside wall of the first post body 41611 is axially provided with a first groove 41613 and a second groove 41614 at an interval. The second post body 41612 is symmetrically provided with driving grooves 41615 from the bottom to mate with the projecting portions 4154 of the driving unit 4151. One end of the second elastic unit 4165 is received in the first groove 41613 of the first post body 41611, and the other end is fixed at the head cover 411.

The guide element 4162 is ring-shaped, sleeved on the first post body 41611 of the driving element 4161 and circumferentially provided with a sliding groove 41621. The pushing rod 4163 comprises a vertical arc-plate-like position portion 41631, a guide rod portion 41632, which horizontally extends outward from the position portion 41631, and a pin 41633, which connects the toggle 4164 to the free end of the guide rod portion 41632. The position portion 41631 is received in the second groove 41614 of the first post body 41611 of the driving element 4161, and the guide rod portion 41632 penetrates through the sliding groove 41621 of the guide element 4162.

As shown in FIGS. 22 and 23, to ensure that the fixing element 413 can better move up and down in the axial direction, a third elastic unit 4134 is axially arranged between the rod portion 4132 of the fixing element 413 and the shaft body 4121 of the output shaft 412. The third elastic unit 4134 is sleeved on the top of the rod portion 4132, with one end pressed against the clipping portion 4133 of the fixing element 413 and the other end pressed against the roof of the bottom section 4125 of the shaft body 4121.

Referring to FIGS. 21-23, the assembling process of some components in the head cover 411 of the oscillating tool 4100 is described in detail. First, install the driving unit 4151 of the driving element 415 in the shaft base 4122 of the output shaft 412, and located the first elastic unit 4156 between the shaft base 4122 and the driving unit 4151; second, install the mating unit 4152 above the driving unit 4151 such that the second meshing portion 41526 of the mating unit 4152 is corresponding to the first meshing portion 4155 of the driving unit 4151; third, insert the rod portion 4132 of the fixing element 413 into the mating unit 4152 from the top down such that the clipping portion 4133 of the fixing element 413 is received in and is in clearance fit with the recess 41524 of the mating portion 4152, the fixing element 413 is axially supported by the mating unit 4152 and the tail end of the rod portion 4132 extends out of the output shaft 412, then connect the pressing portion 4131 of the fixing element 413 to the tail end of the rod portion 4132 in a threaded way; fourth, sleeve the third elastic unit 4134 on the upper end of the rod portion 4132 so that one end of the third elastic unit 4134 is pressed against the clipping portion 4133 and the other end is pressed against the footwall of the bottom section 4125 of the shaft body 4121; fifth, install the shaft body 4121 at the shaft base 4122 such that the two ears 41251 are respectively received in the two recess grooves 41264 and that the two projecting portions 4154 are respectively located in the two recess grooves 41264 of the shaft body 4121; and sixth, sleeve the driving element 4161 of the operation mechanism 416 on the bottom section 4125 of the shaft body 4121, integrate the toggle 4164, the pushing rod 4163 and the guide element 4162 as a whole and sleeve them on the first post body 41611 of the driving element 4161 such that the position portion 41631 of the pushing rod 4163 is correspondingly received in the second groove 41614 on the first post body 41611 and that the two projecting portions 4154 of the driving unit 4151 are respectively located in the two driving grooves 41615 of the driving element 4161; thus far, assembly of the major components in the head cover 411 is finished.

The installation and dismantling processes of the working head 414 of the oscillating tool 4100 in four states in this embodiment are described with reference to FIGS. 23-30. The operation mechanism 416 drives the driving mechanism 415 to move and switch between the first mating position and the second mating position. At the second mating position, the working head 414 can be inserted on one side; after penetrating through the gap 4146 of the working head 414, the rod portion 4132 of the fixing element 413 is located in the center hole 4144 of the working head 414, and the mounting portion 4141 of the working head 414 is located between the pressing portion 4131 of the fixing element 413 and the carrier 4126 of the output shaft 412. When the driving mechanism 415 moves from the second mating position to the first mating position, the fixing element 413 axially moves upward; the distance between the pressing portion 4131 and the footwall 41261 of the carrier 4126 is reduced; finally, the pressing portion 4131 presses the mounting portion 4141 of the working head 414 between the pressing portion 4131 and the carrier portion 4126 and the working head 414 is fixed. On the contrary, when the driving mechanism 415 moves from the first mating position to the second mating position, the fixing element 413 axially moves downward; the distance between the pressing portion 4131 and the footwall 42161 of the carrier 4126 increases; the mounting portion 4141 of the working head 414 is released, and then the working head 414 can be dismantled from the output shaft 412 from one side.

Figure 24:
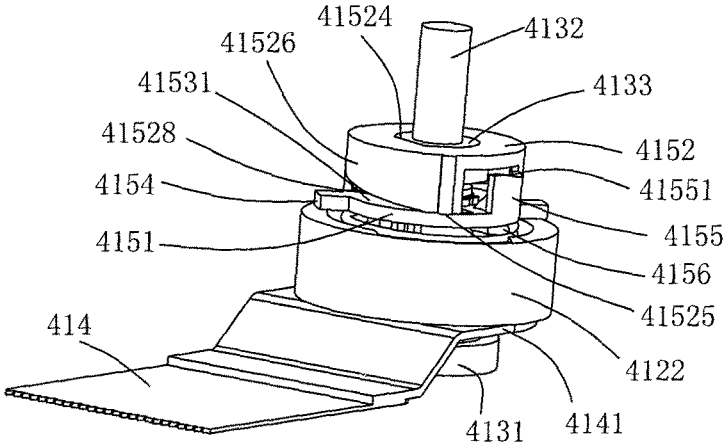
FIG. 24 shows a sectional view of the part of the power tool shown in FIG. 23.

FIGS. 23 and 24 are schematic views of the oscillating tool 4100 in the first state, wherein the driving mechanism 415 is located at the second mating position. At this position, the driving unit 4151 overcomes the spring force of the first elastic unit 4156 and clockwise rotates a certain angle relative to the mating unit 4152; then, the first meshing portion 4155 of the driving unit 4151 is completely staggered with the second meshing portion 41526 of the mating unit 4152, and the first elastic unit 4156 is compressed. By the effect of the gravity force of the third elastic unit 4134 and the mating unit 4152, the mating unit 4152 axially moves downward by a certain distance until the lower surface 41525 of the mating unit 4152 is pressed against the upper surface 41531 of the driving unit 4151. In addition, the second stop 41527 of the mating unit 4152 is received in the first stop 41532 of the driving unit 4151 so as to drive the driving unit 4151 to anticlockwise rotate by the effect of the first elastic unit 4156. In such circumstances, the fixing element 413 is located the releasing position, and the distance between the pressing portion 4131 and the carrier portion 4126 is relatively long and is greater than the thickness of the mounting portion 4141 of the working head 414, so the working head 414 can be installed at the output shaft 412 or dismantled from the output shaft 412 from one side.

It should be pointed out that, the driving mechanism 415 at the first mating position drives the operation mechanism 416 through an external force to bring the driving unit 4151 to rotate a certain angle and overcome the torsional force of the first elastic unit 4156. At this mating position, even if the external force is removed, because the first stop 41532 of the driving unit 4151 is mated with the second stop 41527 of the mating unit 4152, the driving unit 4151 still cannot anticlockwise rotate when driven the torsional force of the first elastic unit 4156. Thus, the fixing element 413 is maintained at the releasing position.

Figure 25:
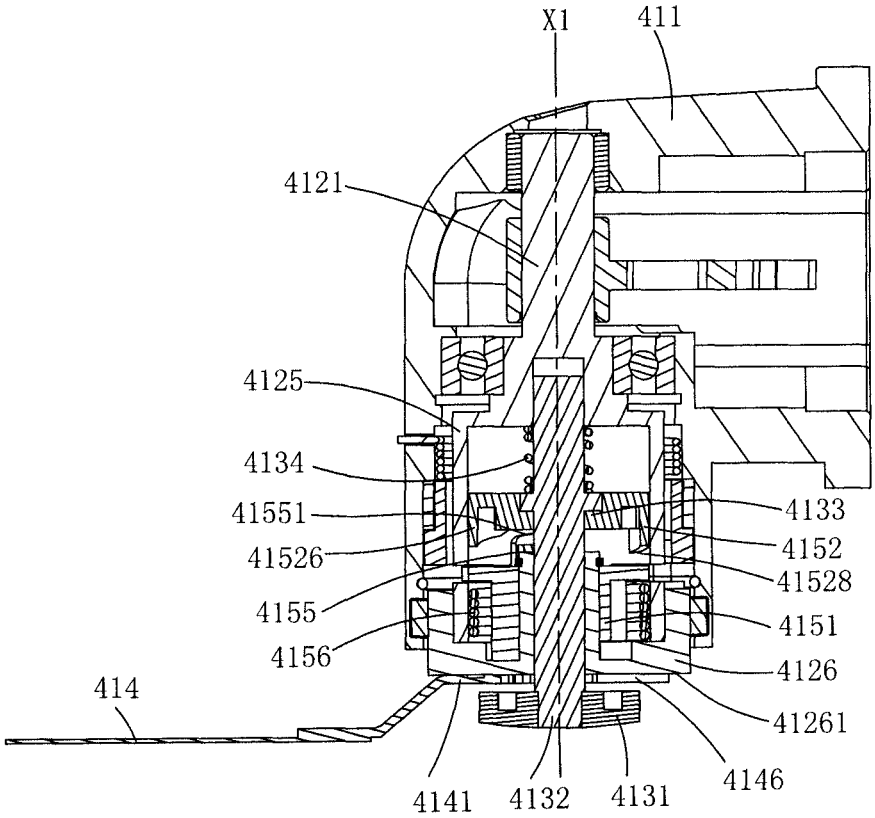
FIG. 25 shows a three-dimensional view of the part of the power tool shown in FIG. 21 in a second status, while the driving mechanism is between a second mating position and a first mating position and the working head is released.
Figure 26:
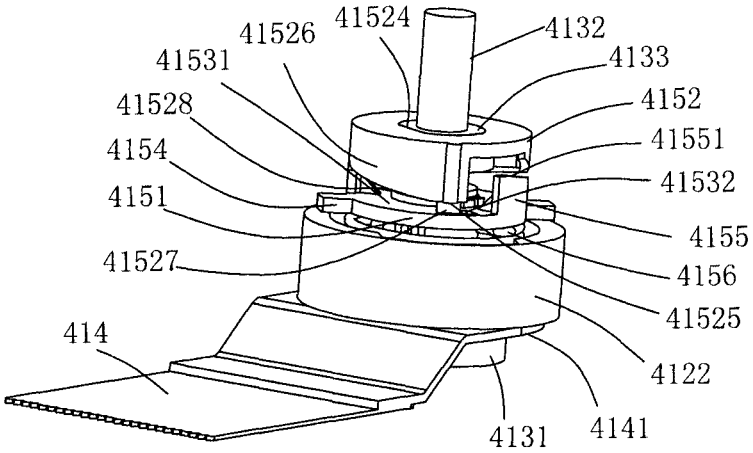
FIG. 26 shows a sectional view of the part of the power tool shown in FIG. 25.

FIGS. 25 and 26 are schematic views of the oscillating tool 4100 in the second state, wherein the driving mechanism 415 is located between the first mating position and the second mating position. The user presses the pressing portion 4131 of the fixing element 413; then, the rod portion 4132 overcomes the spring force of the third elastic unit 4134 through the clipping portion 4133 to drive the mating unit 4152 to axially move upward by a certain distance, and the pressing portion 4131 of the fixing element 413 does not compress the mounting portion 4141 of the working head 414, yet. In addition, in this state, the mating unit 4152 axially moves upward by a certain distance, but the second stop 41527 of the second mating unit 4152 is not completely axially separated from the first stop 41532 of the driving unit 4151, and the second stop 41527 still stops the first stop 41532. Therefore, the driving unit 4151 still cannot rotate by the effect of the anticlockwise torsional force of the first elastic unit 4156. In such circumstances, the first meshing surface 41551 of the driving unit 4151 and the second meshing surface 41528 of the mating unit 4152 form certain spacing in the axial direction.

Figure 27:
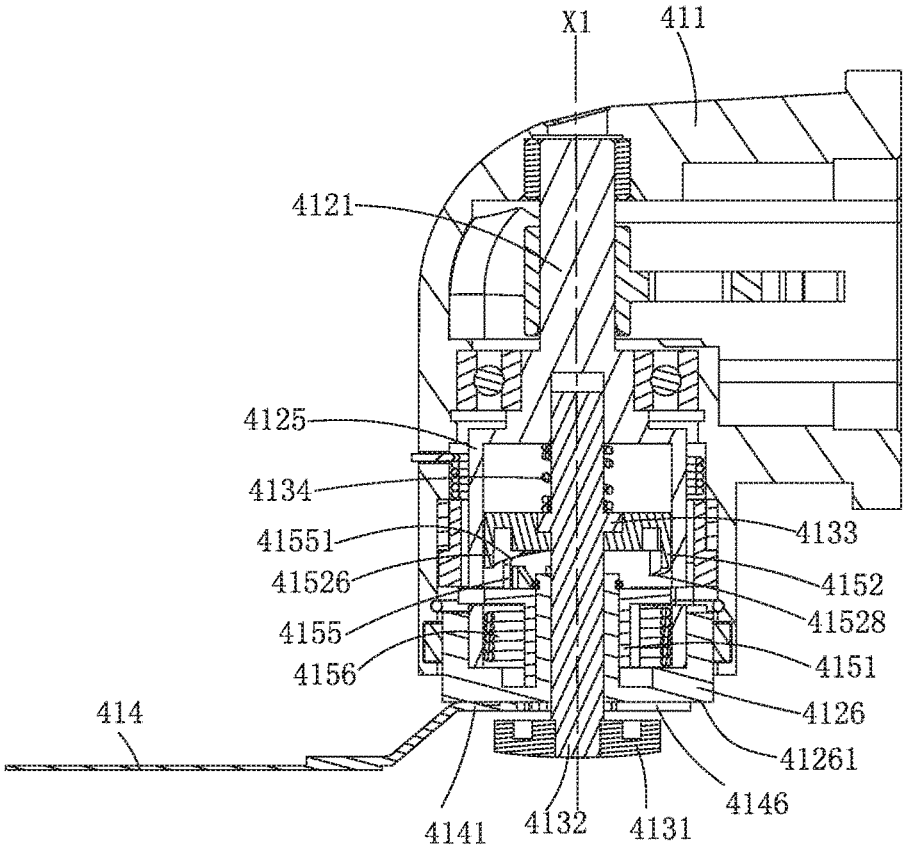
FIG. 27 shows a three-dimensional view of the part of the power tool shown in FIG. 21 in a third status, while the driving mechanism is between a second mating position and a first mating position and the working head is released.
Figure 28:
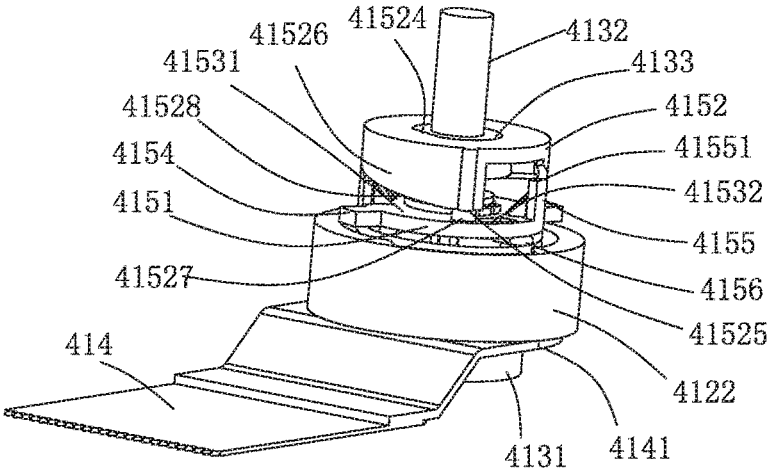
FIG. 28 shows a sectional view of the part of the power tool shown in FIG. 27.

FIGS. 27 and 28 are schematic views of the oscillating tool 4100 in the third state, wherein the driving mechanism 415 is still located between the first mating position and the second mating position. The fixing element 413 is further pushed upward and drives the mating unit 4152 to further axially move upward, so the second stop 41527 of the mating unit 4152 is completely axially separated from the first stop 41532 of the driving unit 4151. After the resistance applied by the mating unit 4152 is removed, the driving unit 4151 starts to rotate anticlockwise by the effect of the torsional force of the first elastic unit 4156. The driving unit 4151 rotates around the axis X1 relative to the mating unit 4152, driving the mating unit 4152 to axially move upward through the mating between the first meshing surface 41551 and the second meshing surface 41528. In this state, the pressing portion 4131 of the fixing element 413 and the mounting portion 4141 of the working head 414 still maintain a certain axial distance. In such circumstances, the pressing portion 4131 does not press the mounting portion 4141 and the working head 414 is still not clamped.

Figure 29:
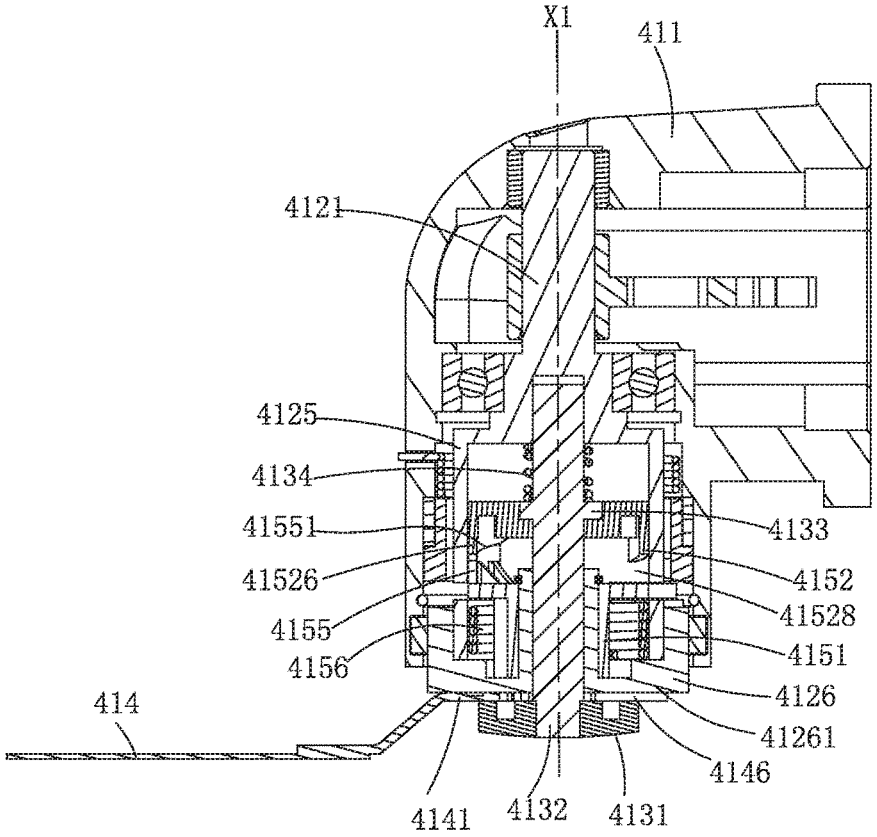
FIG. 29 shows a three-dimensional view of the part of the power tool shown in FIG. 21 in a fourth status, while the driving mechanism is in a first mating position and the working head is clamped.
Figure 30:
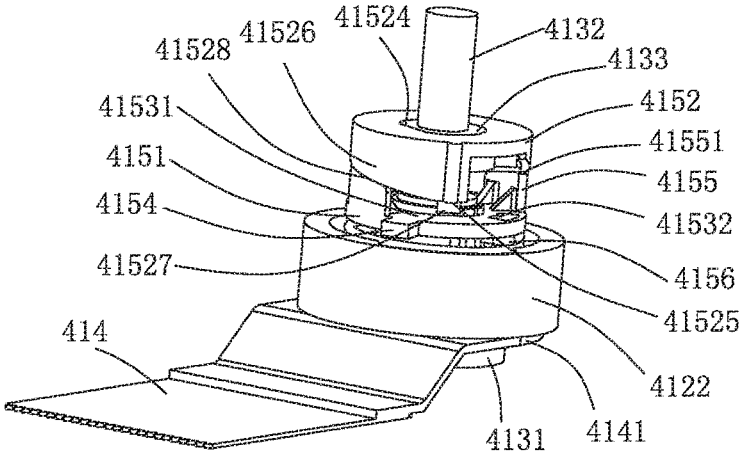
FIG. 30 shows a sectional view of the part of the power tool shown in FIG. 29.
Figure 31:
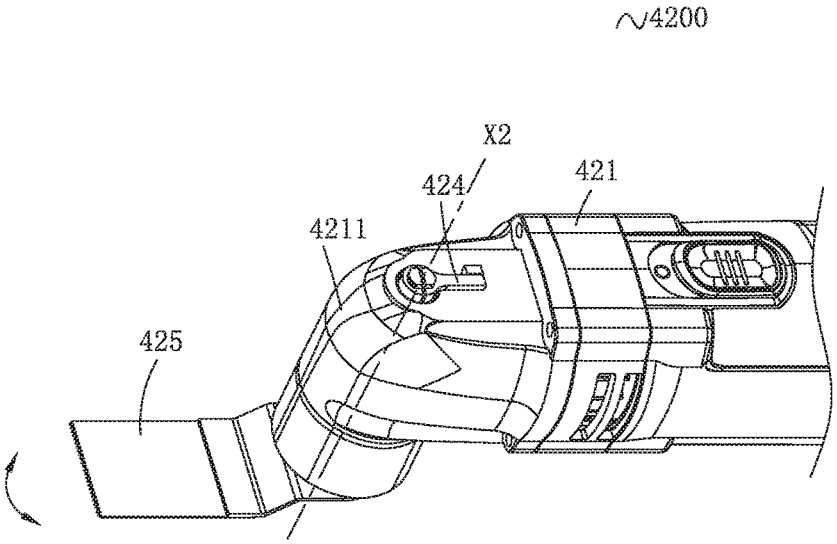
FIG. 31 shows a three-dimensional view of the power tool according to a fifth embodiment of the disclosure.

FIGS. 29 and 30 are schematic views of the oscillating tool 4100 in the fourth state, wherein the driving mechanism 415 is located at the first mating position, and the working head 414 is clamped between the pressing portion 4131 of the fixing element 413 and the carrier 4126 of the output shaft 412. By the effect of the torsional force of the first elastic unit 4156, the driving unit 4151 further rotated anticlockwise, and then the pressing portion 4131 of the fixing element 413 tightly presses the mounting portion 4141 of the working head 414 to axially fix the working head 414. After the axial spacing between the mounting portion 4141 of the working head 414 and the pressing portion 4131 of the fixing element 413 is completely removed, the clipping portion 4133 of the fixing element 413 is supported by the recess 41524 of the mating unit 4152, so the driving unit 4151 stops rotating. In this embodiment, the first lift angle of the first meshing surface 41551 is relatively small, set as 9 degrees, so that the first meshing surface 41551 of the driving unit 4151 and the second meshing surface 41528 of the mating unit 4152 can realize self-locking in the axial direction when mated, thus preventing the working head 45 from loosening when receiving a relatively large axial load. In addition, in the process that the driving mechanism 415 moves from the second mating position to the first mating position, the rotating movement distance of the driving unit 4151 is greater than the axial upward movement distance of the mating unit 4152 to ensure that the driving unit 4151 and the mating unit 4152 can realize self-locking at the first mating position.

It should be pointed out that, in this embodiment, the first lift angle of the first meshing surface 41551 of the driving unit 4151 is not limited to 9 degrees; the driving unit 4151 is made of steel or iron; the friction coefficient of the first meshing surface 14551 (41551) is in the scope of 0.1-0.15, so self-locking can be implemented when the first lift angle is in the scope of 9-17 degrees according to the bevel self-locking principle. Obviously, when the driving unit 4151 is made of other materials, the scope of the first lift angle also changes correspondingly.

The clamping process of the working head 414 of the oscillating tool 4100 in this embodiment is described in detail above, and the releasing process of the working head 414 is opposite to the clamping process. With reference to FIGS. 21 and 30, in order to dismantle the output shaft 412 of the working head 414, manually pull the toggle 4164 of the operation mechanism 416 to drive the driving element 4161 to rotate clockwise. After the driving element 4161 rotates a certain angle, the driving groove 41615 starts meshing with the projecting portion 4154 of the driving unit 4151 so as to drive the driving unit 4151 to rotate clockwise. When the driving unit 4151 rotates relative to the mating unit 4152, the first meshing surface 41551 and the second meshing surface 41528 rotate relative to each other, so the mating unit 4152 axially moves downward by the effect of the spring force of the third elastic unit 4134 until the second stop 41527 of the mating unit 4152 is inserted into the first stop 41532 of the driving unit 4151, and then the lower surface 41252 of the mating unit 4152 is pressed against the upper surface 41532 of the driving unit 4151.

In the process of axially moving downward, the mating unit 4152 drives the fixing element 413 to axially move downward and finally pushes the fixing element 413 out of the output shaft 412 by a certain distance, and then the pressing portion 4131 and the mounting portion 4141 of the working head 414 form spacing there-between to release the working head 414, thus dismantling the working head 414 from the output shaft 412.

In conclusion, the oscillating tool 4100 in the embodiment has the driving mechanism 415 with the driving unit 4151 and the mating driving 4152; the driving unit 4151 and the mating unit 4152 are respectively provided with the first meshing surface 41552 and the second meshing surface 41528; and both the first meshing surface 41551 and the second meshing surface 41528 are set as cam surfaces. When rotating around the axis X1, the driving unit 4151 can drive the mating unit 4152 to axially move through mating between the first meshing surface 41551 and the second meshing surface 41528 so as to drive the pressing portion 4131 of the fixing element 413 to press or release the working head 414. This structure is conveniently operated, and can realize bevel self-locking after the lift angle of the first meshing surface 41551 is set in a certain scope, thus ensuring stability of the work. When the driving mechanism 415 is located at the first mating position, the driving unit 4151 rigidly supports the 4152, and the mating unit 4152 further rigidly supports the fixing element 413, thus preventing the working head 414 from loosening and slippage on condition of excessive load. It should be pointed out that, the "rigid support" there refers to that the driving mechanism 415 does not axially deform and cannot be elastically compressed by the effect of an axial outer force after the fixing element 413 is supported by the driving mechanism 415.

In addition, the first elastic unit 4156 is arranged between the driving unit 4151 and the output shaft 412 to drive the driving unit 413 to automatically rotate from the second mating position back to the first mating position when the fixing element 413 is fixed, saving operation steps and improving the operation convenience of the oscillating tool 4100.

It should be pointed that, in this embodiment, the driving unit 4151 is axially located below the mating unit 4152, and the first meshing surface 41551 is set as the cam surface. The present disclosure is not limited to this embodiment. The first meshing surface may also be set as other curved surfaces or a plane forming an acute angle with the axis X1. In addition, the mounting portion 4141 of the working head 414 is provided with the gap 4146, so the working head 414 can be installed at the output shaft 412 from one side. The present disclosure is not limited to this embodiment, and the mounting portion of the working head may also not be provided with the gap. To install this kind of working head, the pressing portion of the fixing element can be removed from the rod portion first, and after the working head is equipped at the rod portion of the fixing element, re-installed at the rod portion.

Embodiment 5

In the fourth embedment, the driving unit of the driving mechanism is axially located below the mating unit. Obviously, the driving unit may also be located above the mating unit. In such circumstances, the mating unit and the output shaft are integrated. The fifth embodiment of the present disclosure is described below with reference to FIGS. 31-39.

Referring to FIGS. 31-34, an oscillating tool 4200 in this embodiment comprises a housing 421, an output shaft 422 installed in the housing 421, a driving mechanism 423 arranged in the output shaft 422, an operation mechanism 424 extending out of the housing 421, a working head 425 installed at the tail end of the output shaft 422 and a fixing element 426 for fixing the working head 425. The housing 421 has a head cover 4211; and the output shaft 422 is arranged in the head cover 4211 and extends out of the lower end of the head cover 4211. The operation mechanism 425 is arranged in the output shaft 422 and partly extends out of the upper end of the head cover 4211.

The output shaft 422 is hollow, comprising a shaft body 4221 and a shaft base 4222 installed below the shaft body 4221. The shaft body 4221 comprises a cylindrical top section 42211 and a bottom section 42212, which is located below the top section 42211 and has a bigger diameter. The shaft base 4222 comprises a plate-like carrier 42221.

The fixing element 426 comprises a plate-like pressing portion 4261 and a rod portion 4262 that axially extends upward. The free end of the rod portion 4262 is provided with a T-shaped clipping portion 4263. The working head 425 comprises a mounting portion 4251 arranged between carrier 42221 of the output shaft 422 and the pressing portion 4261 of the fixing element 426. The mounting portion 4251 is provided with a gap 4252 on one side.

The driving mechanism 423 can switch between the first mating position and the second mating position, driving the fixing element 426 to axially move such that the pressing portion 4261 of the fixing element 426 presses or releases the mounting portion 4251 of the working head 425. The driving mechanism 423 comprises a driving unit 4231 and a mating unit 4232, which can rotate relative to each other. When rotating around the axis X2 of the output shaft 422, the driving unit 4231 is driven to axially move upward through meshing with the mating unit 4232 and finally drives the fixing element 426 to axially move upward. In addition, when the driving mechanism 423 moves from the second mating position to the first mating position, the rotation distance of the driving unit 4231 is greater than axial movement distance thereof to ensure that the driving mechanism 423 can stably supports the fixing element 423 at the mating position and prevent the fixing element 423 from loosening.

Figure 32:
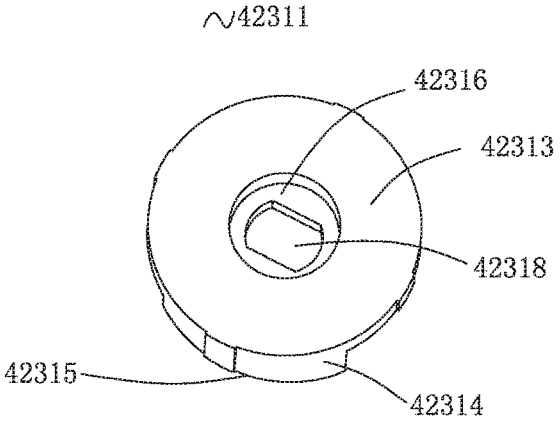
FIG. 32 shows a three-dimensional view of the base portion of the driving unit on the power tool shown in FIG. 31.
Figure 33:
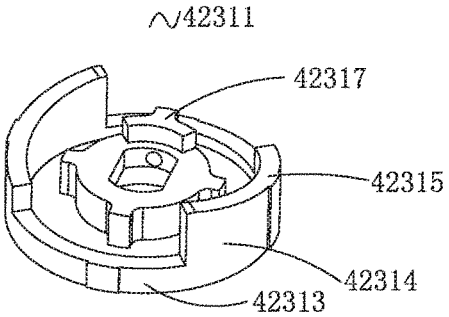
FIG. 33 shows a three-dimensional view of the base portion of the driving unit along another direction shown in FIG. 32.
Figure 34:
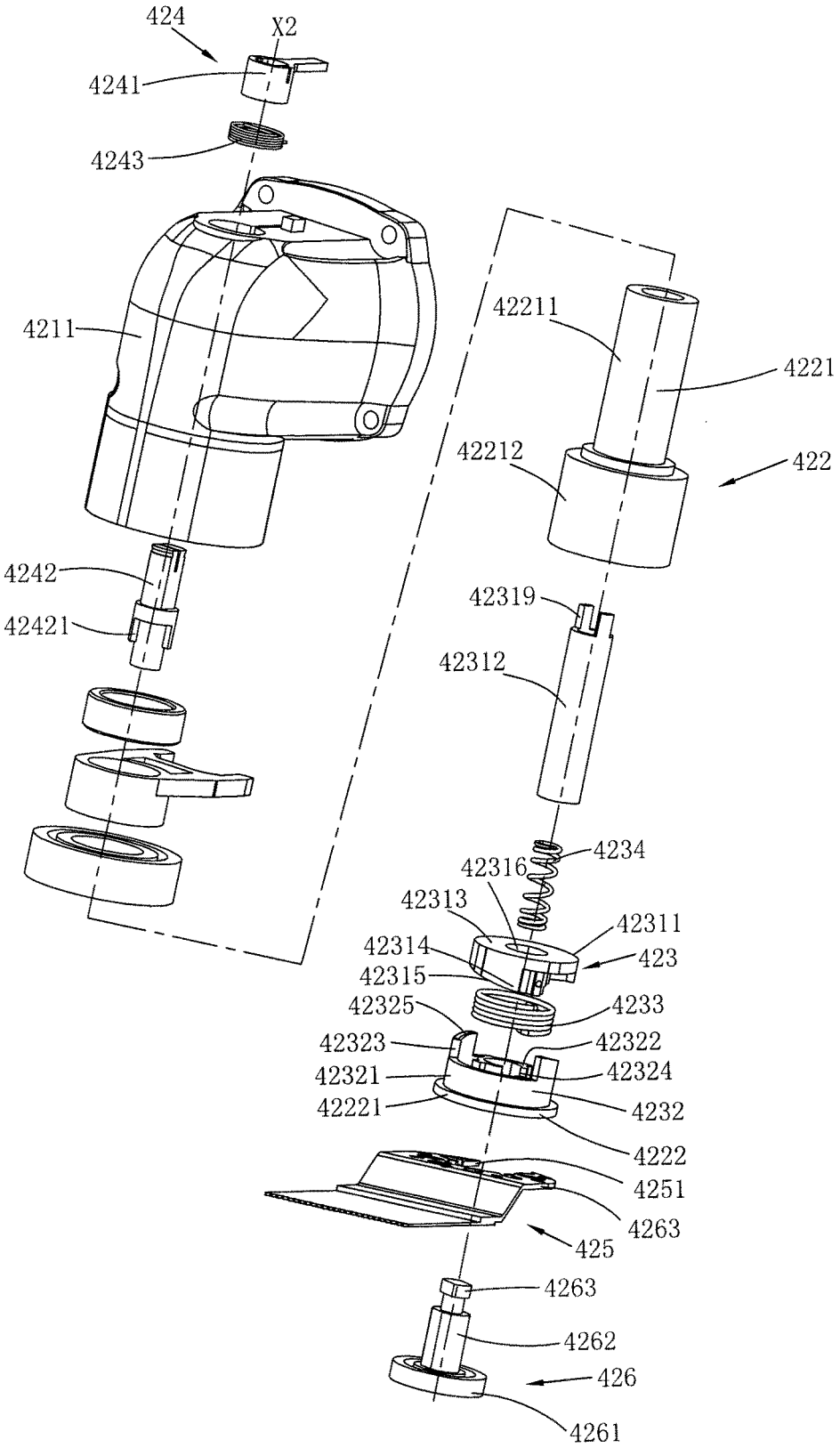
FIG. 34 shows a three-dimensional exploded view of the part of the power tool shown in FIG. 31.

Referring to FIGS. 32-34. The driving unit 4231 is axially located above the mating unit 4232, comprising an approximately cylindrical base portion 42311 and a hollow and cylindrical sleeve 42312 installed above the base portion 42311. The base portion 42311 comprises a round roof 42313 and first meshing portions 42314, which respectively axially extend from the two sides of the roof 42313. The first meshing portions 42314 have cam-shaped end faces, and tops thereof form a first meshing surface 42315. The first meshing surface 42315 is a cam surface. The upper part of the roof 42313 is provided with a round recess 42316 and the lower part axially protrudes and extends to form a first stop 42317. The footwall of the recess 42316 is provided with a mid bore 42318 through which the clipping portion 4263 of the fixing element 426 penetrates. The mid bore 42318 is flat and square, so the clipping portion 4263 can be clipped in the recess 42316 after rotating a certain angle, and then the fixing element 426 and the driving unit 4231 are axially relatively fixed. The lower end of the sleeve 42312 is received in and is in clearance fit with the recess 42316 of the base portion 42311. The top of the sleeve 42312 forms two first driving portions 42319 that axially protrude and extend and are arranged oppositely.

In this embodiment, the mating unit 4232 is integrally molded at the shaft base 4222 of the output shaft 4422, fixedly arranged relative to the output shaft 422. The mating unit 4232 comprises a hollow and cylindrical base body 42321, which axially extends upwards from the carrier 42221 of the shaft base 4222, a smaller hollow and cylindrical inner coat 42322, and second meshing portions 42323, which respectively axially extend from the two sides of the base body 42321. The inner coat 42322 is provided with a second stop 42324 capable of being mated with the first stop 42317 of the driving unit 4231, and the second stop 42324 specifically is a groove. The second meshing portions 42323 respectively correspondingly mated with the first meshing portions 42315 of the driving unit 4231, are similarly shaped, namely the end-faced cams having second meshing surfaces 42325, which are cam surfaces.

A first elastic unit 4233 is arranged between the driving unit 4231 and the mating unit 4232, capable of driving the driving mechanism 423 to automatically return from the second mating position to the first mating position. The driving mechanism 423 also comprises a second elastic unit 4234 axially arranged above the driving unit 4231. After axially moving upward, the driving unit 4231 compresses the second elastic unit 4234.

The operation mechanism 424 is used to drive the driving unit 4231 to rotate around the axis X2 so as to drive the driving mechanism 423 to switch between the first mating position and the second mating position. The operation mechanism 424 specifically comprises a handle 4241 located on the top of the head cover 4211, a driving rod 4242 connected below the handle 4241 and a third elastic unit 4243 arranged between the handle 4241 and the driving rod 4242. The driving rod 4242 is approximately cylindrical, having a flat square top and circumferentially connected with the handle 4241 in a no-rotary way; the two sides of the lower end of the driving rod 4242 are respectively provided with grooves, forming a second driving portion 42421 mated with the first driving portion 42319 of the driving unit 4231.

When the handle 4241 of the operation mechanism 424 is operated to rotate around the axis X2, the handle 4241 drives the driving rod 4242 to rotate. The driving rod 4242 is mated with the first driving portion 42319 of the driving unit 4231, driving the driving unit 4231 to rotate around the axis X2. When rotating relative to the mating unit 4232, the driving unit 4231 drives the fixing element 426 to axially move up and down through mating between the first meshing portion 42314 and the second meshing portion 42323, so that the pressing portion 4261 of the fixing element 426 presses or releases the mounting portion 4251 of the working head 425. When the driving mechanism 423 is located at the first mating position, the fixing element 426 presses the working head 425; when the driving mechanism is located at the second mating position, the fixing element 426 releases the working head 425.

Figure 35:
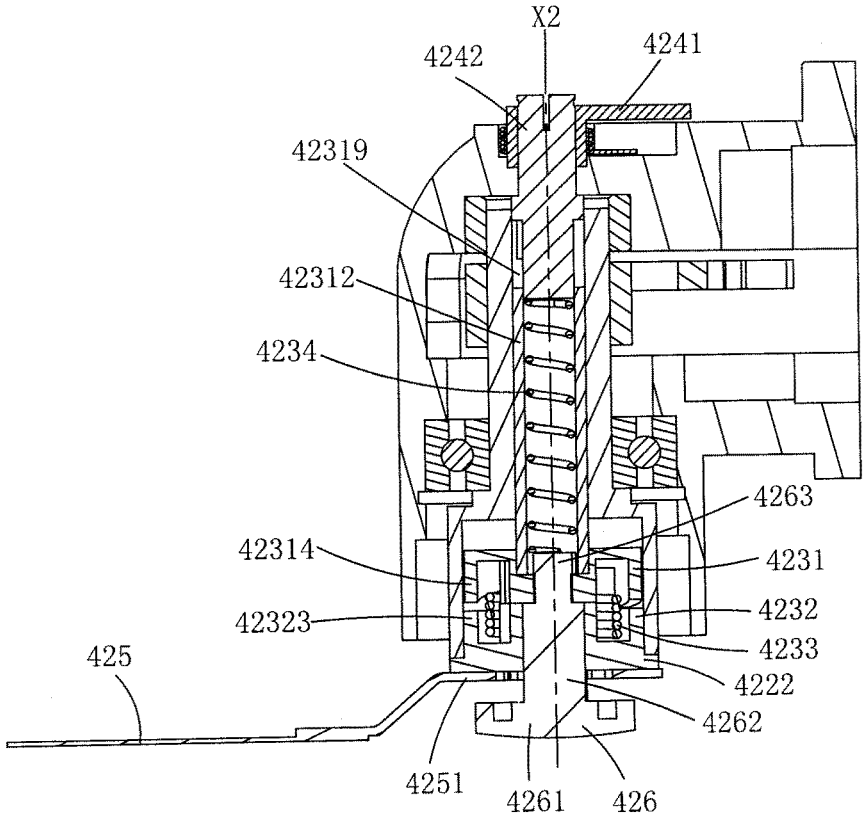
FIG. 35 shows a three-dimensional view of the part of the power tool shown in FIG. 31 in a first status, while the driving mechanism is in a second mating position and the working head is released.
Figure 36:
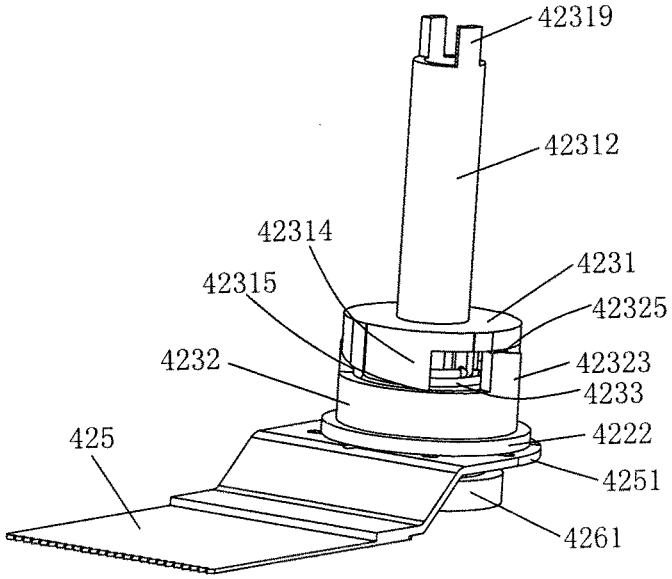
FIG. 36 shows a sectional view of the part of the power tool shown in FIG. 35.

The installation and dismantling processes of the working head 425 of the oscillating tool 4200 in this embodiment in three states are described with reference to FIGS. 35-40. As shown in FIGS. 35 and 36, in the first state, the driving mechanism 423 is located at the second mating position. In such circumstances, the driving unit 4231 overcomes the spring force of the first elastic unit 4233 and overcomes a certain angle, and then the first meshing portion 24314 of the driving unit 4231 is disengaged with the second meshing portion 42323 of the mating portion 4232. The driving unit 4231 axially moves downward to a relatively low position to drive the pressing portion 4231 of the fixing element 423 to move away from the carrier 4222 of the output shaft 422; then, spacing appears between the pressing portion 4261 and the mounting portion 4251 of the working head 425; and finally, the working head 425 is released. In this state, the first stop 42317 of the driving unit 4231 is mated with the second stop 42324 of the mating unit 4232 to force the driving unit 4231 to rotate clockwise by the effect of the spring force of the first elastic unit 4233, so the driving mechanism 423 is maintained at the second mating position.

Figure 37:
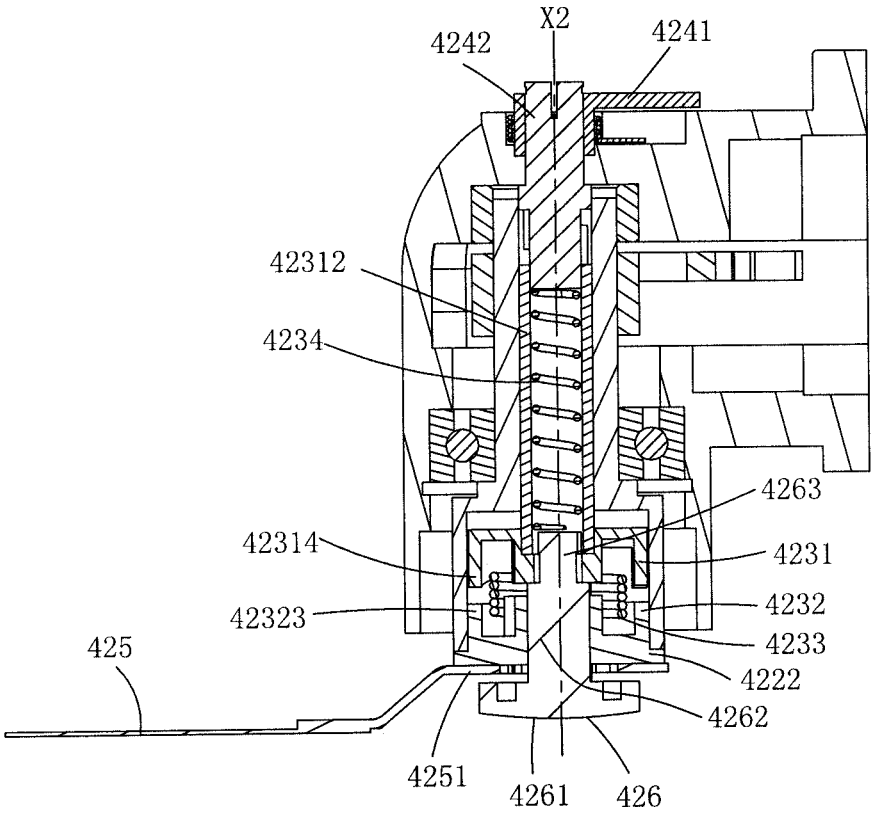
FIG. 37 shows a three-dimensional view of the part of the power tool shown in FIG. 31 in a second status, while the driving mechanism is between a second mating position and a first mating position.
Figure 38:
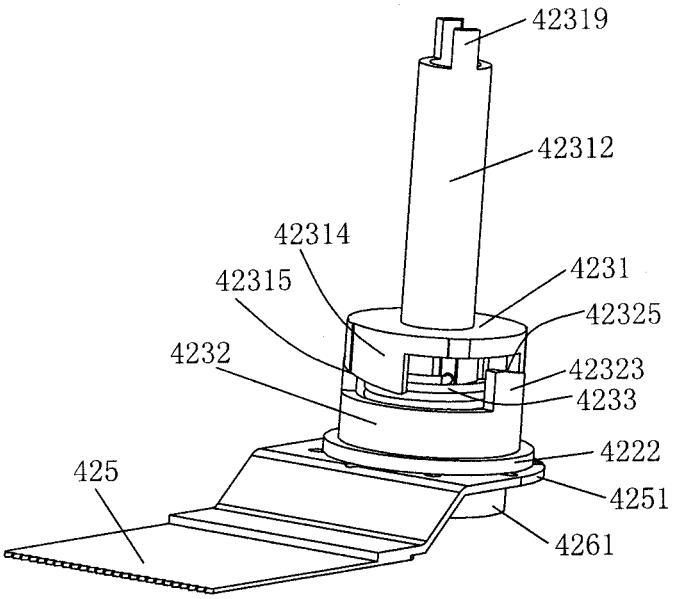
FIG. 38 shows a sectional view of the part of the power tool shown in FIG. 37.

As shown in FIGS. 37 and 38, in the second state, the driving mechanism 423 is located between the second mating position and the first mating position. When the driving mechanism 423 is located at the second mating position, manually press the pressing portion 4261 of the fixing element 426, the rod portion 4262 of the fixing element 426 will drive the driving unit 4231 to together axially move upward, and force the first stop 42317 of the driving unit 4231 to disengage with the second stop 42324 of the mating unit 4232. In this state, the driving unit 4231 starts to rotate clockwise relative to the mating unit 4232 by the effect of the spring force of the first elastic unit 4233. When rotating relative to the mating unit 4232, the driving unit 4231 is further driven to axially move upward through the mating between the first meshing surface 42315 and the second meshing surface 42325, and then the driving mechanism 423 automatically moves towards the first mating position.

Figure 39:
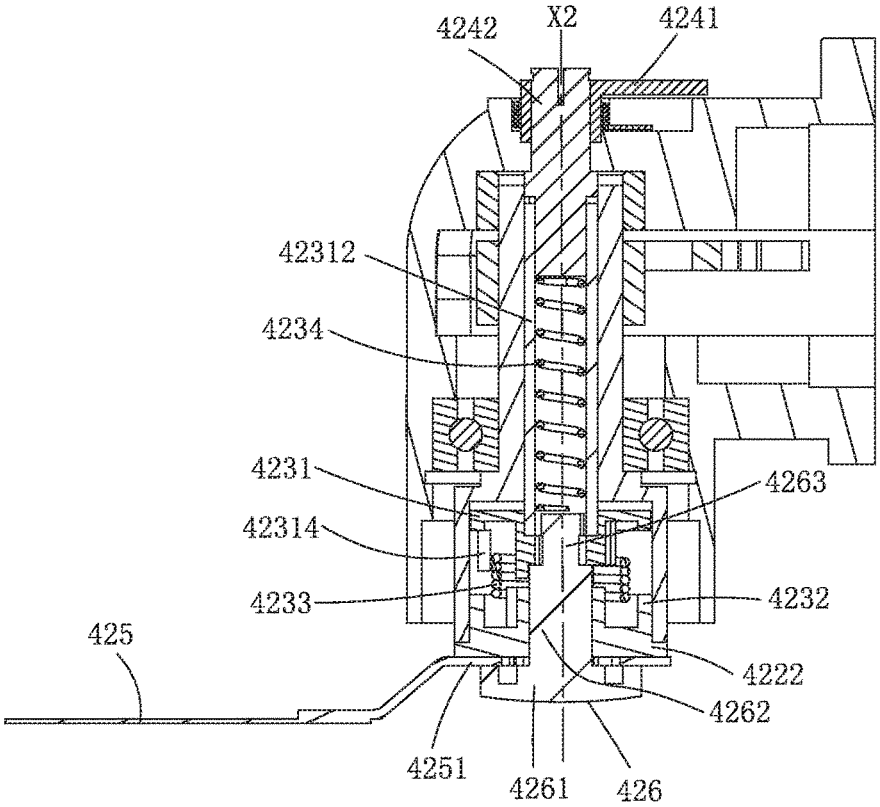
FIG. 39 shows a three-dimensional view of the part of the power tool shown in FIG. 31 in a third status, while the driving mechanism is in a first mating position and the working head is clamped.
Figure 40:
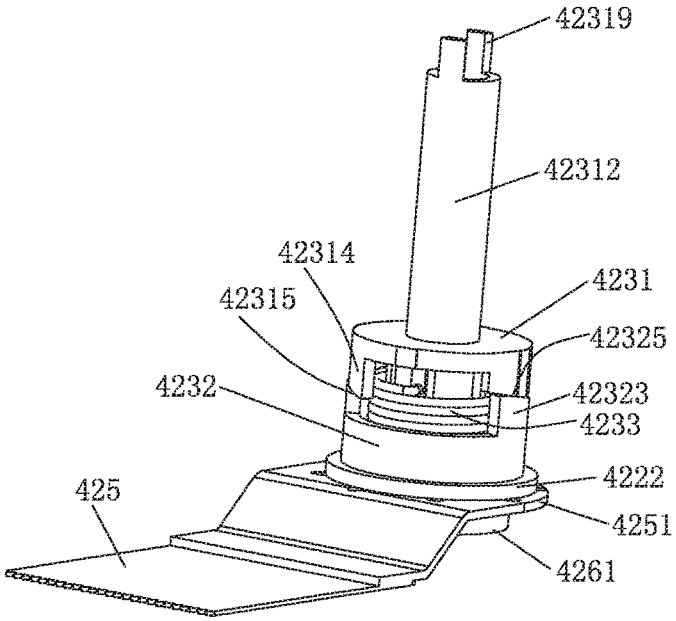
FIG. 40 shows a sectional view of the part of the power tool shown in FIG. 39.

As shown in FIGS. 39 and 40, in the third state, the driving mechanism 423 moves from the second mating position to the first mating position. In this state, the driving unit 4231 of the driving mechanism 423 is in the second state and continuously rotates around the axis X2 relative to the mating unit 4232, and the driving unit 4231 further axially moves upward. The driving unit 4231 also drives the fixing element 426 to axially moves upward at the same time until the pressing portion 4261 of the fixing element 426 presses the mounting 4251 of the working head 425 to steadily fix the working head 425 at the carrier 4222 of the output shaft 422. In this process, the first driving portion 42319 of the driving unit 4231 only slides in the second driving portion 42421 of the mating unit 4232 and does not perform meshing circumferentially to drive the handle 4241 to rotate.

The above three states describe the process that the driving mechanism 423 moves from the second mating position to the first mating position to press and fix the working head 425. The dismantling process of the working head is approximately opposite to the fixing process of the working head 425. The driving mechanism 423 is moved from the first mating position to the second mating position through the operation mechanism 424, and then the fixing element 426 is axially moved downward to release to the working head 425. Specifically, when the driving mechanism 423 is located at the first mating position, manually operate the rotate clockwise, and then the second driving portion 42421 of the driving unit 4231 to mesh with the first driving portion 42319 of the driving unit 4231 to drive the driving unit 4231 to rotate clockwise around the axis X2 relative to the mating unit 4231. After the driving unit 4231 rotates relative to the mating unit 4232, the first meshing surface 42315 rotates clockwise relative to the second meshing surface 42325, and the driving unit 4231 also axially moves downward by the effect of the second elastic unit 4234 and finally drives the fixing element 426 to axially move downward. So, the pressing portion 4261 of the fixing element 426 releases the working head 425 and then the working head 425 can be dismantled from the carrier 4222 of the output shaft 422.

Embodiment 6

In the fourth and fifth embodiments, the driving unit of the driving mechanism all rotates around the axis of the output shaft to drive the mating unit to axially move and drive the driving mechanism to move between the first mating position and the second mating position. However, the present disclosure is not limited to the above structures. The driving mechanism of the present disclosure may also employ other structures, for example: the driving unit rotates around the straight line vertical to the axis of the output shaft. The sixth embodiment of the present disclosure is described below with reference to FIGS. 41-45.

Figure 41:
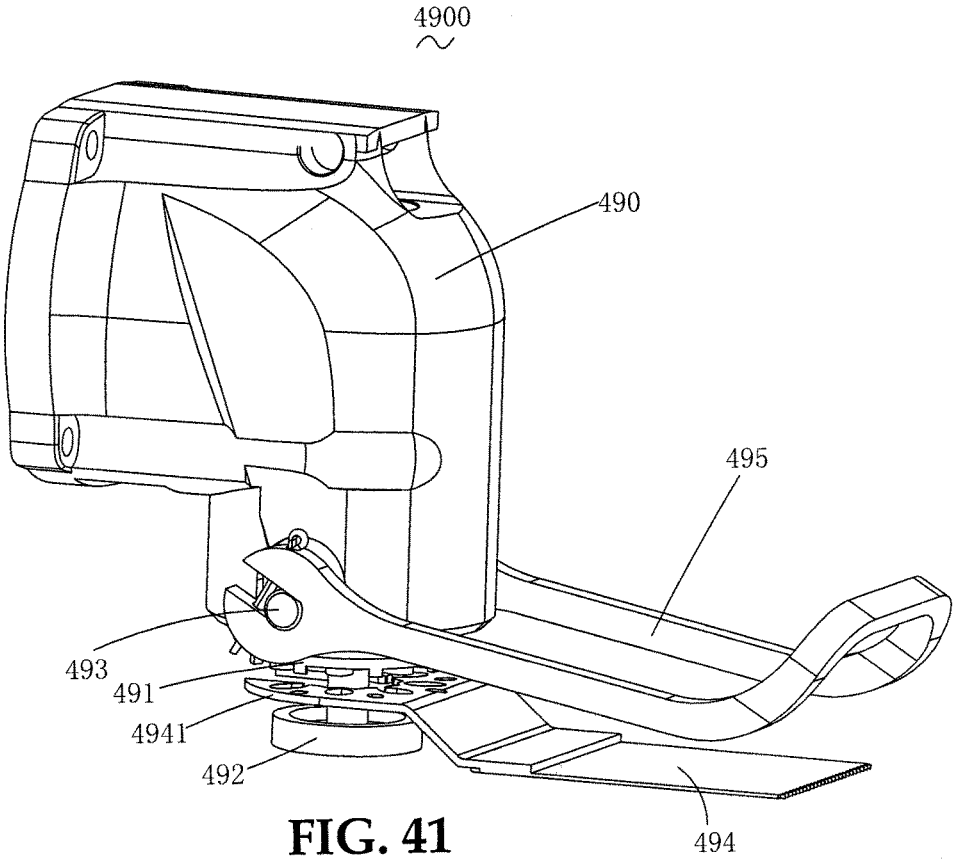
FIG. 41 shows a three-dimensional view of the part of the power tool according to a sixth embodiment of the disclosure in a first status, while the driving mechanism is in a second mating position and the working head is released.
Figure 43:
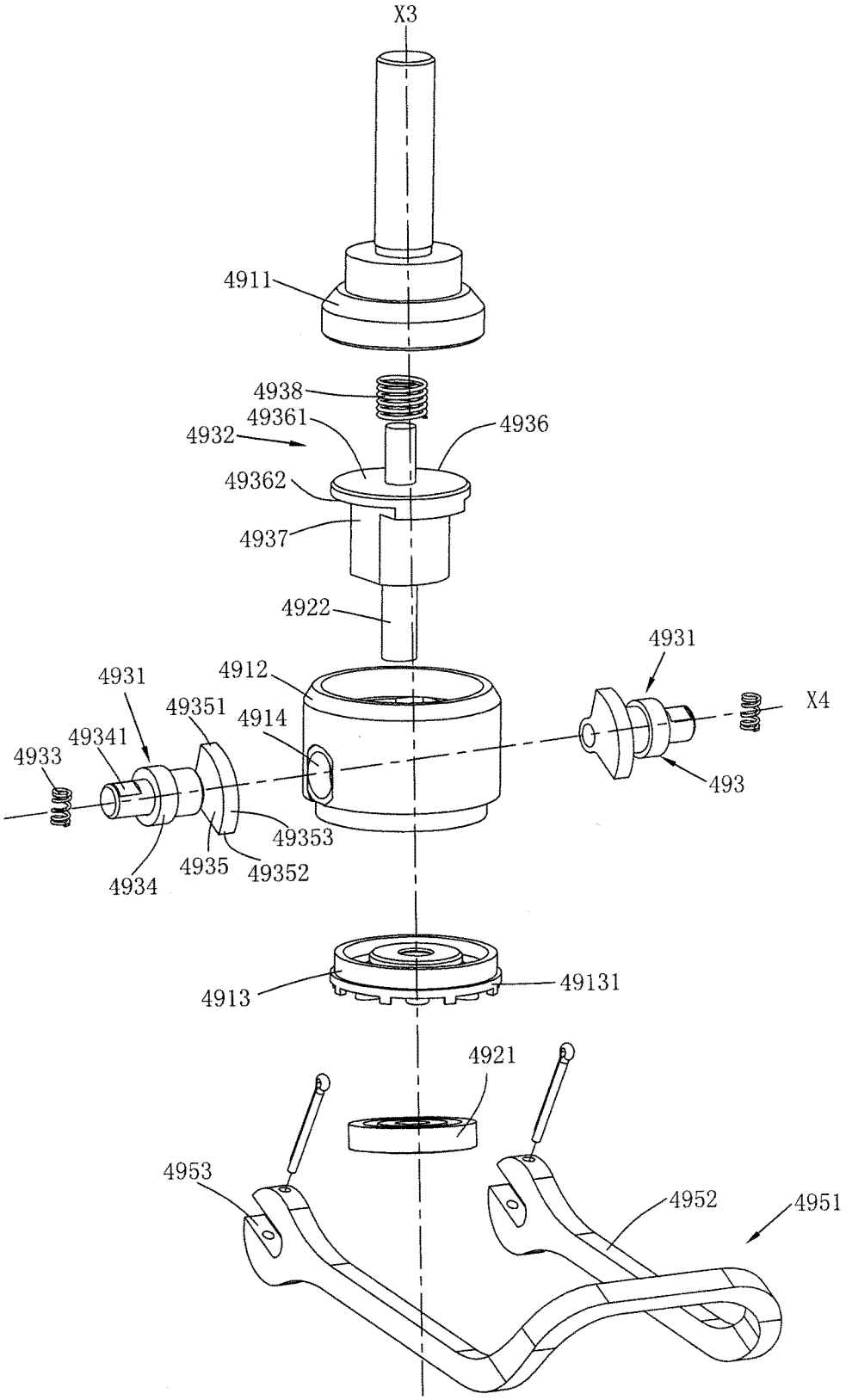
FIG. 43 shows a three-dimensional exploded view of the part of the power tool shown in FIG. 41.

As shown in FIGS. 41 and 43, this embodiment specifically provides an oscillating tool 4900, comprising a head cover 490, an output shat 491 installed in the head cover 490, a fixing element 492 capable of being axially movably fixed in the output shaft 491, a driving mechanism 493 for driving the fixing element 492 to axially move, a working head 494 arranged between the fixing element 492 and the output shaft, and an operation mechanism 495 for operably driving the driving mechanism 493 to move. The driving mechanism 493 can move between the first mating position and the second mating position such that the fixing element 492 clamps or releases the working head 494. The driving mechanism 493 is also provided with a first elastic unit 4930, which can drive the driving mechanism 493 to automatically return from the second mating position back to the first mating position.

Figure 42:
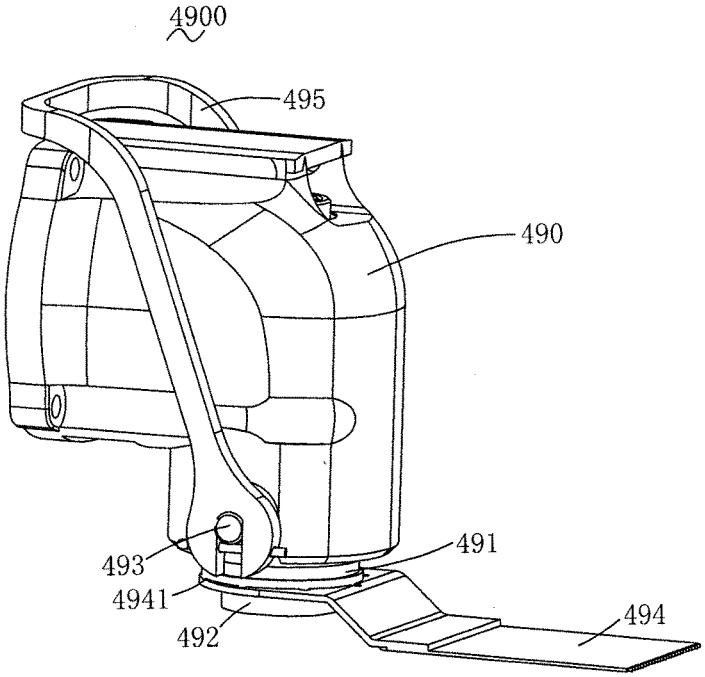
FIG. 42 shows a three-dimensional view of the part of the power tool shown in FIG. 41 in a second status, while the driving mechanism is in a first mating position and the working head is clamped.
Figure 44:
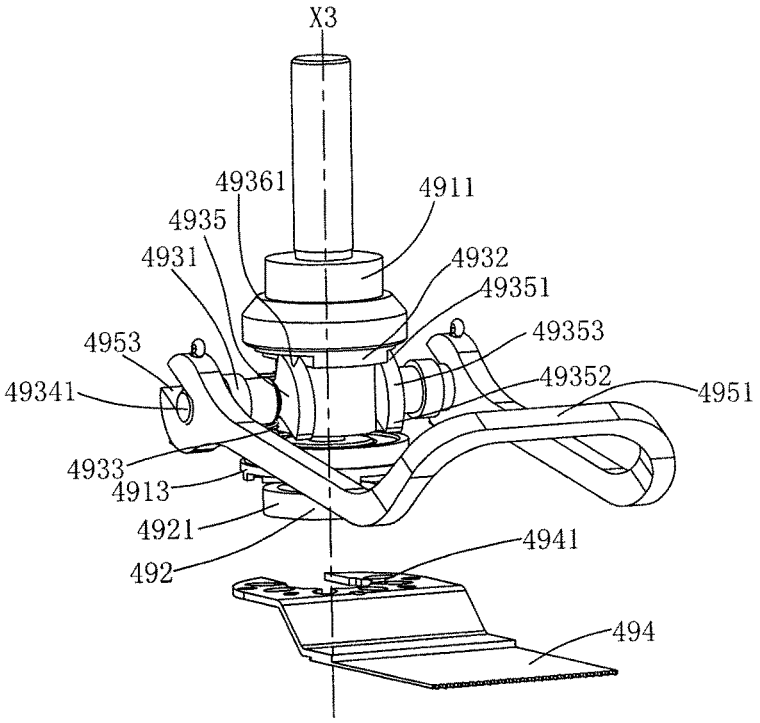
FIG. 44 shows a three-dimensional view of the part of the power tool shown in FIG. 41 in a second status, while the driving mechanism is in a second mating position and the working head is released.
Figure 45:
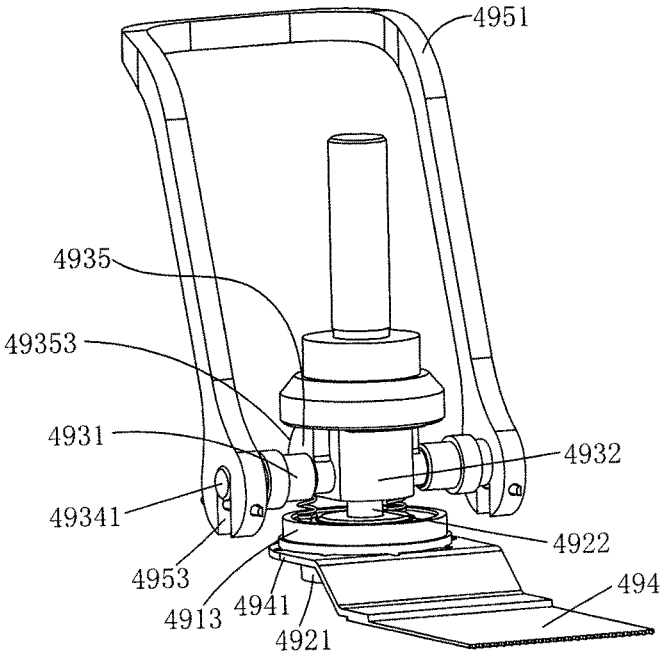
FIG. 45 shows a three-dimensional view of the part of the power tool shown in FIG. 41 in a second status, while the driving mechanism is in a first mating position and the working head is clamped.

The fixing element 492 has a pressing portion 4921 and a rod portion 4922, which axially extends upward from the center of the pressing portion 4921. As shown in FIGS. 41 and 44, the driving mechanism 493 is located at the second mating position; there is a certain spacing between the pressing portion 4921 of the fixing element 492 and a mounting portion 4941 of the working head 494; the working head 494 is not pressed by the pressing portion 4921 of the fixing element 492; and thus, the working head 494 can be dismantled from the output shaft 491. As shown in FIGS. 42 and 45, the driving mechanism 493 is located at the first mating position; the spacing between the pressing portion 4921 of the fixing element 492 and the mounting portion 4941 of the working head 494 is removed; the working head 494 is pressed by the pressing portion 4921 of the fixing element 492 and clamped between the fixing element 492 and the output shaft 491.

As shown in FIG. 43, in this embodiment, the output shaft 491 has an axis X3, specifically comprising a shaft body 4911 and a shaft base 4913, which are axially arranged in sequence, wherein a shaft sleeve 4912 is approximately hollow and cylindrical; the two sides of the shaft sleeve 4912 are symmetrically provided with two through holes 4914; and the bottom of the shaft base 4913 is used to install a carrier 49131 of the working head 494. The driving mechanism 493 specifically comprises driving units 4931, a mating unit 4932 supported on the driving units 4931 and a first elastic unit 4913 connected to the driving units 4931. When rotating, the driving units 4931 can drive the mating unit 4932 to axially move up and down.

Each driving unit 4931 has an axis X4 vertical to the axis X3, comprising a cylindrical shaft portion 4934 extending along the axis X4 and a cam portion 4935 connected to one end of the shaft portion 4934. The other end of the shaft portion 4934 opposite to the cam portion 4935 is processed to form a flat square portion 49341. The cam portion 4935 is approximately sector-shaped, is a circumferential cam, and is plate-like and approximately vertical to the axis X4. The cam portion has a lower end 49351 close to the axis X4 and a top end 49352 far away from the axis X4. The lower end 49351 and the top end 49352 together fount a first meshing surface 49353. The first meshing surface 49353 is a cam surface.

In this embodiment, there are two driving units 4931, symmetrically arranged relative to the axis X3. During assembly, two shaft portions 4934 are installed in the through holes 4914 on two sides of the shaft sleeve 4912 and can rotate around the axis X4. The two cam portions 4935 are received in the shaft sleeve 4912. A first elastic unit 4933 is arranged between each driving unit 4931 and the shaft base 4913. When the driving mechanism 493 is located at the second position, the first elastic units 4933 are stretched by a certain length by the driving units 4931 and therefore can drive the driving mechanism 493 to automatically return from the second mating position back to the first mating position.

In this embodiment, the mating unit 4932 and the fixing element 492 are integrally molded, arranged at the rod portion 4922 of the fixing element 492. Obviously, the mating unit 4932 and the fixing element 492 may be split. The mating unit 4932 is received in the shaft sleeve 4912, and axially supported by the cam portions 4935 of the driving units 4931. The mating unit 4932 is approximately T-shaped, comprising a plate-like mating section 4936 on the top and a supporting portion 4936 below the mating section 4936. The mating section 4936 is vertical to the axis X3; the cross section vertical to the axis X3 is round; and the two sides respectively protrude by a certain distance relative to the supporting section 4936 to form meshing portions 49361, which are respectively meshed with the cam portions 4935 of the driving units 4931. The two meshing portions 49361 are respectively supported above the cam portions 4935 of the driving units 4931, and the bottoms of the meshing portions 49361 form a second meshing surface 49362 meshed with the first meshing surface 49353 of the cam portions 4935. In this embodiment, the second meshing surface 49362 specifically is a plane vertical to the axis X3.

In addition, the driving mechanism 493 also comprises a third elastic unit 4938 arranged between the mating unit 4932 and the shaft body 4911 of the output shaft 491. In this embodiment, when the driving mechanism 493 moves from the first mating position to the second mating position, rotation of the driving units 4931 drives the mating unit 4932 to overcome the spring force of the third elastic unit to move upward; or, when the driving mechanism 493 is located at the second position, the fixing element 492 can be axially pressed to drive the mating section 4932 to axially move upward.

The operation mechanism 495 can be manually operated to drive the driving mechanism 493 to switch between the first mating position and the second mating position. In this embodiment, the operation mechanism 495 mainly comprises a handle 4951. The handle 4951 is approximately U-shaped, having two opposite arm portions 4952. The free ends of the arm portions 4952 are provided with U-shaped grooves 4953. The two flat square portions 49341 of the driving units 4931 are respectively received in the grooves 4953 of the handle 4951, so when the handle 4951 is rotated around the axis X4, the driving units 4931 can be driven to rotate around the axis X4 through mating between the grooves 4953 and the flat square portions 49341.

The installation and dismantling processes of the working head 494 in this embodiment are described in detail below with reference to FIGS. 44 and 45. In use, the handle 4951 to manually pulled to rotate around the axis X4 in a reciprocating way so as to drive the driving mechanism 493 to switch between the first mating position and the second mating position and so as to drive the fixing element 492 to axially move, so the pressing portion 4921 of the fixing element 492 presses or releases the mounting portion 4941 of the working head 494. When the handle 4951 rotates anticlockwise, the driving units 4931 are driven to rotate through mating between the grooves 4953 and the flat square portions 49341; the first meshing surface 49353 of the driving units 4931 meshes with the second meshing surface 9362 of the mating unit 4932, sliding from the lower ends 49351 to the top ends 49352 of the cam portions 4935 so as to axially support the mating unit 4932 in the axial direction and drive the mating unit 4932 to axially move upward; then, the rod portion 4922 of the fixing element 492 drives the fixing element 492 to axially move upward as a whole such that the pressing portion 4921 of the fixing element 492 presses the working head 494. The process that the driving mechanism 493 releases the working head 494 is opposite. It is only needed to pull the handle 4951 when the driving mechanism 493 is located at the first mating position.

Referring to FIG. 44, the driving mechanism 493 is located at the second mating position, and there is relatively large spacing between the pressing portion 4921 of the fixing element 492 and the carrier 49131 of the output shaft 491, so the working head 494 can be installed in the output shaft 491 or dismantled from the output shaft 491 from one side. At this position, the handle 4951 is approximately vertical to the output shaft 491, and the lower ends 49351 of the cam portions 4935 of the driving units 4931 support the meshing portion 49361 of the mating unit 4932. By the effect of the second elastic unit 4938, the mating unit 4932 axially moves downward to a relatively low position to drive the fixing element 492 to axially move downward, and then the spacing between the pressing portion 4921 of the fixing element 492 and the mounting portion of the working head 494 to finally release the working head 494.

Referring to FIG. 45, when the driving mechanism 493 is located at the second mating position, axially press the pressing portion 4921 of the fixing element 492 upward, and then the fixing element 492 drives the mating unit 4932 to overcome the spring force of the second elastic unit 4938 to axially move upward. In such circumstances, by the effect of the elastic pulling force of the first elastic unit 4933, the driving unit 4931 automatically rotates anticlockwise to drive the handle 4951 to approximately rotate anticlockwise for 90 degrees, so the driving mechanism 493 moves from the second mating position to the first mating position as shown in FIG. 37, and finally the pressing portion 4921 of the fixing element 492 presses the working head 494. In such circumstances, the fixing element 492 is rigidly supported by the mating unit 4932, and the mating unit 4932 is rigidly supported by the driving units 4931, so the distance from the pressing portion 4921 of the fixing element 492 to the carrier 49131 of the output shaft 491 is kept unchanged. It should be pointed out that, the "rigidly supported" here refers to that after the fixing element 492 is supported by the driving mechanism 493, the driving unit 493 does not axially deform and cannot be elastically compressed by the effect of an outer axial force.

When rotating anticlockwise, the handle 4951 drives the driving unit 4931 to rotate anticlockwise around the axis X4 such that the first meshing surface 49353 of the cam portions

4935 slips relative to the second meshing surface 49362 of the mating unit 4932, and the meshing position moves from the lower ends 49351 to the top ends 49352 of the cam portions 4935 so as to drive the mating unit 4932 to overcome the spring force of the second elastic unit 4938 and axially moves upward by a distance. When the driving mechanism 493 is located at the first mating position, the top ends 49362 of the cam portions 4936 of the driving units 4931 support the second meshing surface 49362 of the mating unit 4936. The first meshing surface 49353 is a cam surface, so the first cam surface 49353 and the second meshing surface 49362 form self-locking on certain conditions, thus preventing the fixing element 492 from loosening and steadily clamping the working head 494.

In this embodiment, the driving mechanism 493 moves between the first mating position and the second mating position such that the fixing element 492 axially moves to press or releases the working head 494, and then the working head 494 can be dismantled or installed without other auxiliary tools. In addition, the driving units 4931 and the mating unit 4932 in this embodiment are both made of metal materials and therefore can ensure that the fixing element 492 is rigidly supported and is prevented from loosening. Thus, the working head 494 can be steadily fixed.

Through above three embodiments, it can be known that the power tool of the present disclosure mainly forces the driving mechanism to move between the first mating position and the second mating position through arrangement of the driving unit and the mating unit, which can move relative to each other. The fixing element is supported at either the driving unit or the mating unit. At the first mating position, the fixing element is axially located at a relatively higher position to clamp the working head; at the second mating position, the fixing element is axially located at a relatively low position to release the working head. The driving unit and the mating unit can be provided with the first meshing surface and the second meshing surface, which can be mated with each other; when the driving mechanism is located at the first mating position, the two meshing surfaces form self-locking so as to steadily support the working head. The driving unit can rotate relative to the mating unit. In such circumstances, the first meshing surface may be set as a cam surface, a bevel or other curved surface, which can realize self-locking.

In addition, the driving mechanism is provided with the first elastic unit connected to the driving unit, so the driving unit can automatically return to the original position after movement. Then, the driving mechanism can automatically return from the second mating position back to the first mating position on certain conditions. The second elastic unit is still arranged between the driving mechanism and the output shaft. When the driving mechanism moves from the first mating position to the second mating position, the second elastic unit can elastically push the fixing element out of the output shaft.

It should be pointed out that the power tool of the present disclosure is not limited to the above embodiment and the driving mechanism is not limited to metal materials and may be other non-metallic materials or elastic materials. The driving unit is also not limited to rotation relative to the mating unit, and may also translate relative to the mating unit as long as either the driving unit or the mating unit can axially move upward. In addition, either the driving unit or the driven unit is not limited to the situation of being respectively provided with the first meshing surface and the second meshing surface. Either the driving unit or the driven unit, which is axially located lower, is provided with the first meshing, and the other is provided with a spot or line mated with the meshing surface.

In addition, the locking mechanism in the power tool in the present disclosure is not limited to structures in the above embodiments. Those skilled in this field can easily figure out that the locking mechanisms described in the Description of the Related Art or other means can be used as long as the driving mechanism can axially move upward to lock or release the fixing element.

What is claimed is:

1. A power tool, comprising:

a housing;

an output shaft configured to oscillate about an axis thereof in a reciprocating manner and configured for mounting and driving a working head, the output shaft comprising a carrier extending out of the housing;

a fixing element comprising a pressing portion for fixing the working head at the carrier of the output shaft; and a driving mechanism comprising a driving unit and a mating unit, the driving mechanism configured to shift between a first mating position and a second mating position, wherein the pressing portion of the fixing element is configured to press the working head when the driving mechanism is in the first mating position, and wherein the pressing portion of the fixing element is configured to release the working head when the driving mechanism is in the second mating position, wherein the driving unit and the mating unit are configured to move relative to each other, wherein the fixing element is configured to move axially in response to movement of the driving unit and to be axially fixed by supporting of the driving unit or mating unit in the first mating position, and wherein rotary movement of the driving unit relative to the mating unit moves the driving mechanism between the first mating position and the second mating position.

2. The power tool according to claim 1, wherein the driving unit comprises a first meshing portion and wherein the mating unit comprises a second meshing portion configured to mate with the first meshing portion, wherein at least one of the first meshing portion and the second meshing portion is provided with a first meshing surface for mating.

3. The power tool according to claim 2, wherein the first meshing surface comprises a cam surface.

4. The power tool according to claim 2, wherein the first meshing surface comprises a planar surface, and wherein an angle between the planar surface and the axis of the output shaft is an acute angle.

5. The power tool according to claim 2, wherein at least one of the first meshing portion and the second meshing portion is provided with a second meshing surface for mating with the first meshing surface.

6. The power tool according to claim 1, wherein the driving unit is configured to rotate around at least one of the axis of the output shaft and a line parallel to the axis of the output shaft.

7. The power tool according to claim 1, wherein the driving unit is configured to rotate around a line perpendicular to the axis of the output shaft.

8. The power tool according to claim 1, wherein the driving unit engages the mating unit with an interference fit when the driving mechanism is in the second mating position.

9. A power tool, comprising:

a housing;

an output shaft configured to oscillate about an axis thereof in a reciprocating manner and configured for mounting and driving a working head, the output shaft comprising a carrier extending out of the housing;

a fixing element comprising a pressing portion for fixing the working head at the carrier of the output shaft; and a driving mechanism comprising a driving unit and a mating unit, the driving mechanism configured to shift between a first mating position and a second mating position, wherein the pressing portion of the fixing element is configured to press the working head when the driving mechanism is in the first mating position, and wherein the pressing portion of the fixing element is configured to release the working head when the driving mechanism is in the second mating position, wherein the driving unit and the mating unit are configured to move relative to each other, wherein the fixing element is configured to move axially in response to movement of the driving unit and to be axially fixed by supporting of the driving unit or mating unit in the first mating position, and wherein the driving unit is configured to move a greater distance than an axial distance moved by the fixing element during the process of the driving mechanism moving from the second mating position to the first mating position.

10. A power tool, comprising:

a housing;

an output shaft configured to oscillate about an axis thereof in a reciprocating manner and configured for mounting and driving a working head, the output shaft comprising a carrier extending out of the housing;

a fixing element comprising a pressing portion for fixing the working head at the carrier of the output shaft; and a driving mechanism comprising a driving unit and a mating unit, the driving mechanism configured to shift between a first mating position and a second mating position, wherein the pressing portion of the fixing element is configured to press the working head when the driving mechanism is in the first mating position, and wherein the pressing portion of the fixing element is configured to release the working head when the driving mechanism is in the second mating position, wherein the driving unit and the mating unit are configured to move relative to each other, wherein the fixing element is configured to move axially in response to movement of the driving unit and to be axially fixed by supporting of the driving unit or mating unit in the first mating position, and wherein the fixing element is rigidly supported by the driving mechanism, and wherein an axial distance between the pressing portion of the fixing element and the carrier of the output shaft remains constant while the driving mechanism is in the second mating position.

11. The power tool according to claim 1, wherein the fixing element further comprises a rod portion axially extending from the pressing portion into the output shaft, the rod portion configured to engage with at least one of the driving unit and the mating unit.

12. The power tool according to claim 1, wherein the driving mechanism further comprises a first elastic unit configured to automatically return the driving mechanism from the second mating position to the first mating position after the fixing element moves axially.

13. The power tool according to claim 1, further comprising an operation mechanism configured to move the driving mechanism between the first mating position and the second mating position.

14. The power tool according to claim 1, wherein the driving unit comprises a first stop, the mating unit comprises a second stop, and the first stop of the driving unit engages with the second stop of the mating unit such that the mating unit limits the rotation of the driving unit when the driving mechanism is in the second mating position.

* * * * *